US010683854B2

(12) United States Patent
Divedi et al.

(10) Patent No.: US 10,683,854 B2
(45) Date of Patent: Jun. 16, 2020

(54) RADIAL PISTON DEVICE WITH REDUCED PRESSURE DROP

(71) Applicant: EATON INTELLIGENT POWER LIMITED, Dublin (IE)

(72) Inventors: Anand Kumar Divedi, Purna Nagar Chnichwad (IN); Aswin Chandar, Pune (IN); Kishor Ramdas Borkar, Pune (IN); Dhawal Goyal, Maharashtra (IN)

(73) Assignee: EATON INTELLIGENT POWER LIMITED (IE)

( * ) Notice: Subject to any disclaimer, the term of this patent is extended or adjusted under 35 U.S.C. 154(b) by 215 days.

(21) Appl. No.: 15/576,112

(22) PCT Filed: May 19, 2016

(86) PCT No.: PCT/US2016/033299
§ 371 (c)(1),
(2) Date: Nov. 21, 2017

(87) PCT Pub. No.: WO2016/187439
PCT Pub. Date: Nov. 24, 2016

(65) Prior Publication Data

US 2018/0156206 A1 Jun. 7, 2018

Related U.S. Application Data

(60) Provisional application No. 62/164,892, filed on May 21, 2015.

(51) Int. Cl.
*F04B 1/107* (2020.01)
*F03C 1/047* (2006.01)
(Continued)

(52) U.S. Cl.
CPC ..... *F04B 1/1074* (2013.01); *F03C 1/0438* (2013.01); *F03C 1/0472* (2013.01);
(Continued)

(58) Field of Classification Search
CPC .... F03C 1/0438; F03C 1/0472; F03C 1/0474; F04B 1/1074; F04B 1/0456
See application file for complete search history.

(56) References Cited

U.S. PATENT DOCUMENTS 2,074,068 A * 3/1937 Ferris ..... F01B 13/065 91/496
2,813,492 A 11/1957 Berlyn
(Continued)

FOREIGN PATENT DOCUMENTS

EP 3 048 301 A1 7/2016
EP 2 389 513 B1 11/2016
(Continued)

OTHER PUBLICATIONS

International Search Report and Written Opinion of the International Searching Authority for corresponding International Patent Application No. PCT/US2016/033299 dated Oct. 13, 2016, 16 pages.

*Primary Examiner* — Nathaniel E Wiehe
*Assistant Examiner* — Richard C Drake
(74) *Attorney, Agent, or Firm* — Merchant & Gould P.C.

(57) ABSTRACT

A radial piston device includes a housing, a pintle attached to the housing and having a pintle shaft, a rotor rotatably mounted on the pintle shaft and having cylinders, pistons displaceably received in the cylinders, and a drive shaft coupled to the rotor and rotatably supported within the housing. The radial piston device includes mechanisms for reducing a pressure loss of hydraulic fluid flowing into the pintle shaft.

27 Claims, 15 Drawing Sheets

(51) Int. Cl.

| | |
|---|---|
| ***F03C 1/36*** | (2006.01) |
| ***F04B 1/04*** | (2020.01) |
| ***F04B 1/1074*** | (2020.01) |
| ***F04B 1/0456*** | (2020.01) |
| ***F04B 1/1071*** | (2020.01) |

(52) U.S. Cl.
CPC ..... *F03C 1/0474* (2013.01); *F03C 1/0476* (2013.01); *F04B 1/0456* (2013.01); *F04B 1/1071* (2013.01)

(56) References Cited

U.S. PATENT DOCUMENTS

| | | | | | |
|---|---|---|---|---|---|
| 3,935,794 | A * | 2/1976 | Rumsey | F01B 1/0644 | 91/488 |
| 4,686,829 | A * | 8/1987 | Thoma | F03C 1/0438 | 60/464 |
| 5,079,994 | A * | 1/1992 | Berbuer | F04B 1/1071 | 91/491 |
| 5,295,797 | A * | 3/1994 | Kahrs | F04B 1/1071 | 417/273 |
| 7,484,939 | B2 | 2/2009 | Hansen | | |
| 9,133,830 | B2 * | 9/2015 | Hansen | F04B 1/107 | |
| 9,188,111 | B2 * | 11/2015 | Hansen | F01B 1/0689 | |
| 2004/0065192 | A1 * | 4/2004 | Akasaka | F01B 1/06 | 91/491 |
| 2013/0343914 | A1 * | 12/2013 | Fenny | F04B 1/0404 | 417/53 |
| 2015/0114216 | A1 * | 4/2015 | Skinner, Jr. | F04B 1/107 | 92/72 |
| 2016/0208610 | A1 | 7/2016 | Skinner et al. | | |
| 2016/0252089 | A1 | 9/2016 | Hansen | | |
| 2016/0319799 | A1 * | 11/2016 | Skinner, Jr. | F04B 1/1071 | |
| 2018/0073492 | A1 * | 3/2018 | Smith | F03C 1/046 | |
| 2018/0142677 | A1 * | 5/2018 | Dhuri | F04B 1/1071 | |

FOREIGN PATENT DOCUMENTS

| | | | |
|---|---|---|---|
| GB | 740 487 | A | 11/1955 |
| WO | 83/04284 | A1 | 12/1983 |
| WO | 2014/011899 | A1 | 1/2014 |

* cited by examiner

RADIAL PISTON DEVICE WITH REDUCED PRESSURE DROP

CROSS-REFERENCE TO RELATED APPLICATION

This application is a National Stage Application of PCT/US2016/033299, filed on May 19, 2016, which claims the benefit of U.S. patent application Ser. No. 62/164,892, filed on May 21, 2015, the disclosures of which are incorporated herein by reference in their entireties. To the extent appropriate, a claim of priority is made to each of the above disclosed applications.

BACKGROUND

In aerospace hydraulic applications, engine driven pumps are used to provide a high volumetric flow rate of pressurized oil flow to hydraulic systems. Examples of the engine driven pumps include radial piston devices that operate as pumps. Radial piston devices (either pumps or motors) are characterized by a rotor rotatably engaged with a pintle. The rotor has a number of radially oriented cylinders disposed around the rotor and supports a number of pistons in the cylinders.

Engine driven pumps typically operate to receive hydraulic fluid or oil from a reservoir, and suffer substantial pressure loss along the flow path as the hydraulic fluid reaches the pistons in the pumps. Such pressure loss can cause cavitation inside the pump if the pressure of the hydraulic fluid from the reservoir is not sufficiently high. In the aerospace applications, this issue becomes more significant because aircrafts fly at a height where ambient pressure is significantly lower than on the ground. Furthermore, several rotating components, such as a driveshaft, a rotor, and a coupling adapter, and other components, such as a pintle and a driveshaft chamber, also cause a high pressure drop at the pump. Thus, the engine driven pumps are subject to a low inlet pressure of the hydraulic fluid, thereby increasing a chance of cavitation in the pumps. To reduce the problem, the engine driven pumps are typically equipped with a booster pump arranged upstream of the engine driven pumps. The size of the booster pump is typically determined by the pressure loss of the hydraulic fluid between the reservoir and the piston inlets of the engine driven pump.

One of driving factors for the engine driven pumps is to increase a power density, which is defined as a power to weight ratio. A higher power density achieves a higher operating efficiency of hydraulic systems and ensures lower operating costs in aerospace systems. The pressure loss of the hydraulic fluid at a hydraulic system can require a bigger booster pump, thereby decreasing the power density of the system.

SUMMARY

The present disclosure relates generally to a radial piston device with reduced pressure drop. In one possible configuration and by non-limiting example, the radial piston device includes several mechanisms for reducing the pressure loss of hydraulic fluid flowing into a pintle shaft of the radial piston device.

One aspect is a radial piston device including a housing, a pintle, a rotor, a plurality of pistons, and a drive shaft. The housing may have a hydraulic fluid inlet and a hydraulic fluid outlet. The pintle may have a first end and a second end opposite to the first end along a pintle axis. The pintle may be attached to the housing at the first end and have a pintle shaft between the first end and the second end. The pintle shaft defines a pintle inlet and a pintle outlet. The pintle inlet is in fluid communication with the hydraulic fluid inlet at the second end, and the pintle outlet is in fluid communication with the hydraulic fluid outlet at the first end. The rotor may have a pintle bore mounted onto the pintle shaft. The rotor is configured to rotate relative to the pintle about a rotor axis of rotation that extends through a length of the pintle shaft. The rotor defines a plurality of radially oriented cylinders and defining a plurality of rotor fluid ports. Each of the plurality of pistons is displaceable in each of the plurality of cylinders. The drive shaft may be rotatably supported within the housing and have a driving end and a power transfer end. The drive shaft may include a shaft body at the driving end, a power transfer flange at the power transfer end, and a stem connecting the shaft end and the power transfer flange between the driving end and the power transfer end. The power transfer flange may be coupled to the rotor and define a drive shaft flow passage between the hydraulic fluid inlet and the pintle inlet of the pintle shaft. The stem may include a plurality of arms and an arm connection point. The plurality of arms extends from the power transfer flange and is connected to the arm connection point. The plurality of arms may have portions radially offset from a shaft axis of rotation, and the arm connection point may be connected to the shaft body. The arm connection point is arranged to be axially offset from the drive shaft flow passage toward the shaft body.

The arms may be angled radially outwards as the arms extend from the shaft body to the power transfer flange. The stem may include two arms extending from the power transfer flange to the arm connection point. The two arms may be equally circumferentially spaced apart.

The plurality of arms may have a leading edge and a trailing edge. The leading edge is arranged ahead of the trailing edge in a rotational direction of the drive shaft, and the leading edge faces in the rotational direction of the drive shaft and is configured to be streamlined. The leading edge may have a tapered configuration. In addition, or alternatively, the trailing edge may have a tapered configuration.

The radial piston device may further include a funnel coupled to the pintle shaft at the second end thereof and configured to be open to the drive shaft flow passage to guide a hydraulic fluid from the hydraulic fluid inlet to the pintle inlet. The funnel may be arranged to remain stationary with respect to the pintle shaft as the rotor rotates about the pintle shaft. The drive shaft flow passage may include a tapered inner surface configured to reduce passage losses as hydraulic fluid is drawn into the pintle inlet. The rotor may have a recess configured to receive at least a portion of the funnel for the funnel to be secured to the pintle shaft at the second end of the pintle.

In some examples, the plurality of cylinders may be in paired configuration to form cylinder sets including at least two cylinders. The at least two cylinders are located adjacent one another along an axis parallel to a rotor axis. The cylinder sets are offset from one another along an axis parallel to the rotor axis. The rotor has a rotor inlet face and a rotor outlet face. The first group of the cylinder sets may be arranged closer to the rotor inlet face than to the rotor outlet face, and a second group of the cylinder sets may be arranged closer to the outlet face than to the rotor inlet face. The rotor may include common fluid chambers configured to provide a fluid communication between the cylinder sets and the rotor fluid ports, respectively. A first group of the common fluid chambers, which is associated with the second group of the cylinder sets, may be formed from the rotor inlet face along an axis parallel to the rotor axis. Further, a second group of the common fluid chambers, which is associated with the first group of the cylinder sets, are formed from the rotor outlet face along an axis parallel to the rotor axis. The rotor may include a recess formed around the pintle bore on the rotor inlet face. The recess may be configured to receive at least portion of the funnel.

The housing may include an inlet chamber having a first chamber end and a second chamber end along a longitudinal axis of the housing. The inlet chamber may have a side wall extending between the first chamber end and the second chamber end. The side wall may be configured to have a cross-sectional area of the inlet chamber at the first chamber end smaller than a cross-sectional area of the inlet chamber at the second chamber end. The side wall may be configured to be tapered from the first chamber end to the second chamber end such that a cross-sectional area of the inlet chamber gradually reduces from the first chamber end to the second chamber end.

The pintle may include a pintle wall extending at least partially within the pintle shaft along a pintle axis. The pintle shaft may define a pintle inlet port and a pintle outlet port, and the pintle wall may be configured to divide at least partially the pintle inlet port and the pintle outlet port into a plurality of sections.

Another aspect is a radial piston device having a housing, a pintle, a rotor, a plurality of pistons, and a drive shaft. The housing has a hydraulic fluid inlet and a hydraulic fluid outlet. The pintle is attached to the housing and has a pintle shaft. The pintle shaft defines a pintle inlet and a pintle outlet. The pintle inlet is in fluid communication with the hydraulic fluid inlet, and the pintle outlet is in fluid communication with the hydraulic fluid outlet. The rotor is mounted on the pintle shaft and configured to rotate relative to the pintle about a rotor axis of rotation that extends through a length of the pintle shaft. The rotor defines a plurality of radially oriented cylinder. Each of the plurality of pistons is displaceable in each of the plurality of cylinders. The drive shaft is rotatably supported within the housing and has a driving end and a power transfer end. The drive shaft includes a shaft body at the driving end, a power transfer flange at the power transfer end, and a stem connecting the shaft end and the power transfer flange between the driving end and the power transfer end. The power transfer flange is coupled to the rotor and defines a drive shaft flow passage between the hydraulic fluid inlet and the pintle inlet of the pintle shaft. The stem includes a plurality of arms and an arm connection point. The plurality of arms extends from the power transfer flange and is connected to the arm connection point. The plurality of arms has portions radially offset from a shaft axis of rotation. The arm connection point is connected to the shaft body. The arm connection point is arranged to be axially offset from the drive shaft flow passage toward the shaft body.

The arms may be angled radially outwards as the arms extend from the shaft body to the power transfer flange. The stem may be arranged such that an inlet axis of the hydraulic fluid inlet is arranged between the arm connection point and the power transfer flange. The stem may include two arms extending from the power transfer flange to the arm connection point. The two arms may be equally circumferentially spaced apart.

The plurality of arms may have a leading edge and a trailing edge. The leading edge is arranged ahead of the trailing edge in a rotational direction of the drive shaft, and the leading edge faces in the rotational direction of the drive shaft and being streamlined. The leading edge may have an apex facing in the rotational direction of the drive shaft. The leading edge may have a tapered configuration. The trailing edge of the plurality of arms may be streamlined to form an apex.

Yet another aspect is a radial piston device including a housing, a pintle, a rotor, a plurality of pistons, a drive shaft, and a funnel. The housing has a hydraulic fluid inlet and a hydraulic fluid outlet. The pintle has a first end and a second end opposite to the first end along a pintle axis. The pintle is attached to the housing at the first end and has a pintle shaft between the first end and the second end. The pintle shaft defines a pintle inlet and a pintle outlet. The pintle inlet is in fluid communication with the hydraulic fluid inlet at the second end, and the pintle outlet is in fluid communication with the hydraulic fluid outlet at the first end. The rotor is mounted on the pintle shaft and configured to rotate relative to the pintle about a rotor axis of rotation that extends through a length of the pintle shaft. The rotor defines a plurality of radially oriented cylinders and defining a plurality of rotor fluid ports. Each of the plurality of pistons is displaceable in each of the plurality of cylinders. The drive shaft is rotatably supported within the housing and has a driving end and a power transfer end. The drive shaft includes a shaft body at the driving end, a power transfer flange at the power transfer end, and a stem connecting the shaft end and the power transfer flange between the driving end and the power transfer end. The power transfer flange is coupled to the rotor and defines a drive shaft flow passage between the hydraulic fluid inlet and the pintle inlet of the pintle shaft. The funnel may be coupled to the pintle shaft at the second end thereof and configured to be open to the drive shaft flow passage to guide a hydraulic fluid from the hydraulic fluid inlet to the pintle inlet. The funnel may be arranged to remain stationary with respect to the pintle shaft as the rotor rotates about the pintle shaft. The drive shaft flow passage may include a tapered inner surface configured to reduce passage losses as hydraulic fluid is drawn into the pintle inlet. The radial piston device may further include a flexible coupling interposed between the rotor and the power transfer flange of the drive shaft to couple the rotor to the drive shaft. The funnel may be configured to extend over the flexible coupling to prevent the flexible coupling from being directly exposed to the hydraulic fluid as the hydraulic fluid flows from the hydraulic fluid inlet to the pintle inlet through the drive shaft flow passage. The rotor may have a recess configured to receive at least a portion of the funnel for the funnel to be secured to the pintle shaft at the second end of the pintle.

Yet another aspect is a radial piston device including a housing, a pintle, a rotor, a plurality of pistons, and a drive shaft. The housing has a hydraulic fluid inlet and a hydraulic fluid outlet. The pintle has a first end and a second end opposite to the first end along a pintle axis. The pintle is attached to the housing at the first end and has a pintle shaft between the first end and the second end. The pintle shaft defines a pintle inlet and a pintle outlet. The pintle inlet is in fluid communication with the hydraulic fluid inlet at the second end, and the pintle outlet is in fluid communication with the hydraulic fluid outlet at the first end. The rotor has a pintle bore mounted onto the pintle shaft and is configured to rotate relative to the pintle about a rotor axis of rotation that extends through a length of the pintle shaft. The rotor defines a plurality of radially oriented cylinders and defining a plurality of rotor fluid ports. Each of the plurality of pistons is displaceable in each of the plurality of cylinders. The drive shaft is rotatably supported within the housing and has a driving end and a power transfer end. The drive shaft includes a shaft body at the driving end, a power transfer flange at the power transfer end, and a stem connecting the shaft end and the power transfer flange between the driving end and the power transfer end. The power transfer flange is coupled to the rotor and defines a drive shaft flow passage between the hydraulic fluid inlet and the pintle inlet of the pintle shaft. The plurality of cylinders may be in paired configuration to form cylinder sets including at least two cylinders. The at least two cylinders are located adjacent one another along an axis parallel to a rotor axis. The cylinder sets are offset from one another along an axis parallel to the rotor axis. The rotor has a rotor inlet face and a rotor outlet face. A first group of the cylinder sets are arranged closer to the rotor inlet face than to the rotor outlet face, and a second group of the cylinder sets are arranged closer to the outlet face than to the rotor inlet face. The rotor includes common fluid chambers configured to provide a fluid communication between the cylinder sets and the rotor fluid ports, respectively. A first group of the common fluid chambers, which is associated with the second group of the cylinder sets, may be formed from the rotor inlet face along an axis parallel to the rotor axis. A second group of the common fluid chambers, which is associated with the first group of the cylinder sets, may be formed from the rotor outlet face along an axis parallel to the rotor axis. The rotor may include a recess formed around the pintle bore on the rotor inlet face. The radial piston device may further include a funnel coupled to the pintle shaft at the second end thereof and configured to be open to the drive shaft flow passage to guide a hydraulic fluid from the hydraulic fluid inlet to the pintle inlet. The funnel may be arranged to remain stationary with respect to the pintle shaft as the rotor rotates about the pintle shaft. The recess is configured to receive at least a portion of the funnel. The common fluid chambers are sealed with sealing members.

Yet another aspect is a radial piston device including a housing, a pintle, a rotor, a plurality of pistons, a thrust ring, and a drive shaft. The housing has a hydraulic fluid inlet, an inlet chamber, and a hydraulic fluid outlet. The inlet chamber has a first chamber end and a second chamber end along a longitudinal axis of the housing. The pintle is attached to the housing and includes a pintle shaft defining a pintle inlet and a pintle outlet. The pintle inlet is arranged adjacent the second chamber end of the inlet chamber and in fluid communication with the hydraulic fluid inlet through the inlet chamber. The pintle outlet is in fluid communication with the hydraulic fluid outlet. The rotor is mounted on the pintle shaft and configured to rotate relative to the pintle about a rotor axis of rotation that extends through a length of the pintle shaft. The rotor defines a plurality of radially oriented cylinders and defines a plurality of rotor fluid ports. Each of the plurality of pistons is displaceable in each of the plurality of radially oriented cylinders. The plurality of rotor fluid ports are in fluid communication with the plurality of radially oriented cylinders, and the plurality of rotor fluid ports are alternately in fluid communication with either the pintle inlet or the pintle outlet as the rotor rotates relative to the pintle about the rotor axis of rotation. The thrust ring is disposed about the rotor. The thrust ring is in contact with each of the plurality of pistons. The thrust ring has a thrust ring axis that is radially offset from the rotor axis of rotation so that the plurality of pistons reciprocates radially within the rotor as the rotor rotates about the rotor axis of rotation. The drive shaft is coupled to the rotor and rotatably supported within the housing. The inlet chamber has a side wall extending between the first chamber end and the second chamber end. The side wall may be configured to have a cross-sectional area of the inlet chamber at the first chamber end smaller than a cross-sectional area of the inlet chamber at the second chamber end. The side wall may be configured to be tapered from the first chamber end to the second chamber end such that a cross-sectional area of the inlet chamber gradually reduces from the first chamber end to the second chamber end.

Yet another aspect is a device including a housing, a pintle, a rotor, a plurality of pistons, and a drive shaft. The housing has a hydraulic fluid inlet and a hydraulic fluid outlet. The pintle is attached to the housing and has a pintle shaft. The pintle shaft defines a pintle inlet and a pintle outlet. The pintle inlet is in fluid communication with the hydraulic fluid inlet, and the pintle outlet is in fluid communication with the hydraulic fluid outlet. The rotor is rotatably mounted on the pintle shaft and having a plurality of cylinders. Each of the plurality of pistons is displaceable in each of the plurality of cylinders. The drive shaft is coupled to the rotor and rotatably supported within the housing. The pintle shaft defines a first fluid communication between the hydraulic fluid inlet and at least part of the plurality of cylinders and a second fluid communication between at least part of the plurality of cylinders and the hydraulic fluid outlet. The pintle includes a pintle wall extending at least partially within the pintle shaft along a pintle axis. The pintle wall may be configured to divide at least partially the pintle inlet into a plurality of sections. The pintle wall may be configured to divide at least partially the pintle outlet into a plurality of sections. The pintle wall may be configured to divide at least partially the pintle inlet and the pintle outlet into a plurality of sections. The pintle shaft defines a pintle inlet port and a pintle outlet port, and the pintle wall may be configured to divide at least partially the pintle inlet port into a plurality of sections. The pintle shaft defines a pintle inlet port and a pintle outlet port, and the pintle wall may be configured to divide at least partially the pintle outlet port into a plurality of sections. The pintle shaft defines a pintle inlet port and a pintle outlet port, and the pintle wall may be configured to divide at least partially the pintle inlet port and the pintle outlet port into a plurality of sections.

DETAILED DESCRIPTION

Figure 1:
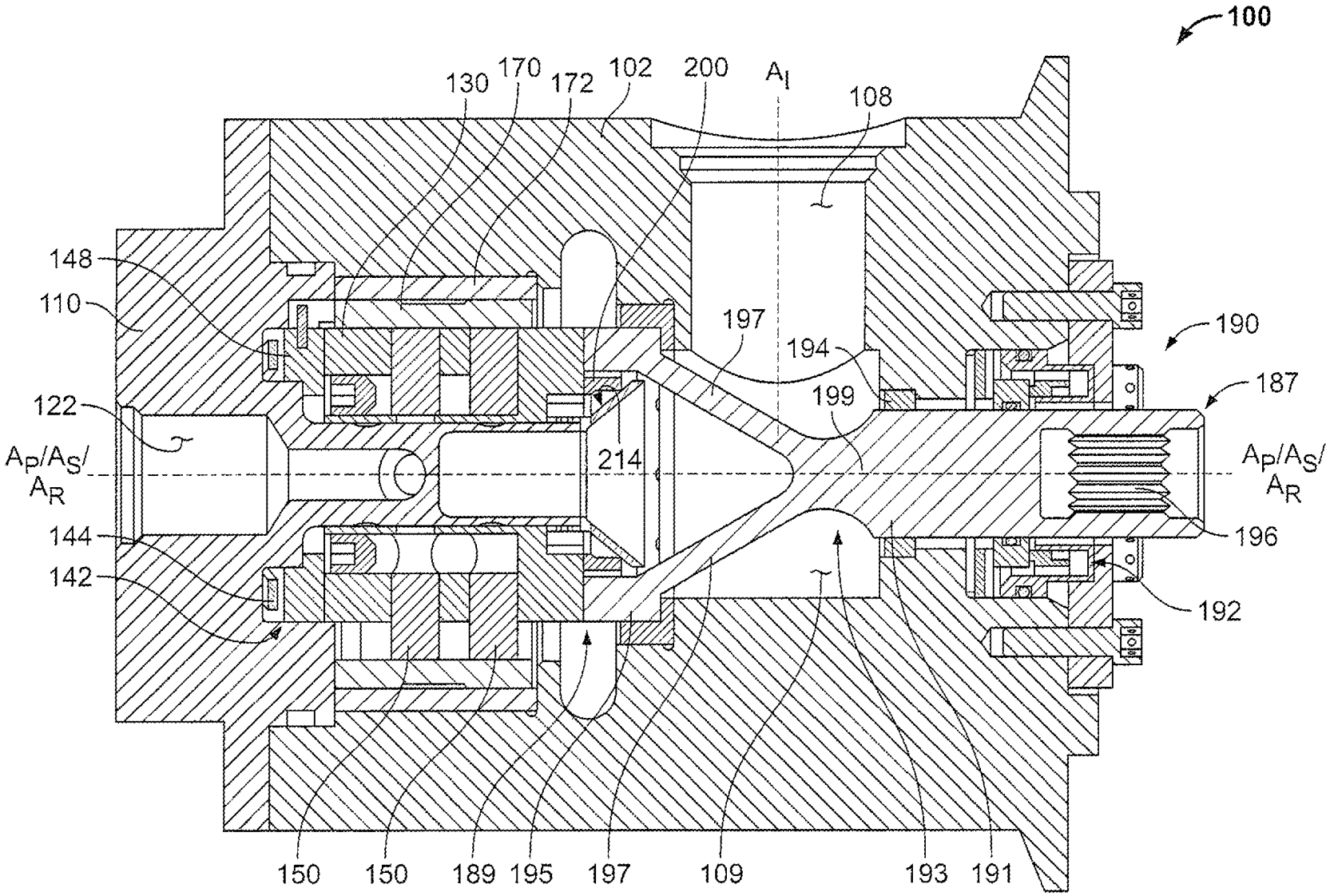
FIG. 1 is a side sectional view of an exemplary radial piston device.

Various examples will be described in detail with reference to the drawings, wherein like reference numerals represent like parts and assemblies throughout the several views. Reference to various examples does not limit the scope of the disclosure and the aspects upon which the examples are based. Additionally, any examples set forth in this specification are not intended to be limiting and merely set forth some of the many possible ways in which the various aspects of the present disclosure may be put into practice.

In the present disclosure, radial piston devices are described generally. These devices may be used in both motor and pump applications, as required. Certain differences between motor and pump applications are described herein when appropriate, but additional differences and similarities would also be apparent to a person of skill in the art. The radial piston device disclosed herein exhibits high power density, is capable of high speed operation, and has high efficiency. Although the technology herein is described in the context of radial piston devices, the benefits of the technologies described may also be applicable to any device in which the pistons are oriented between an axial position and a radial position.

Figure 2:
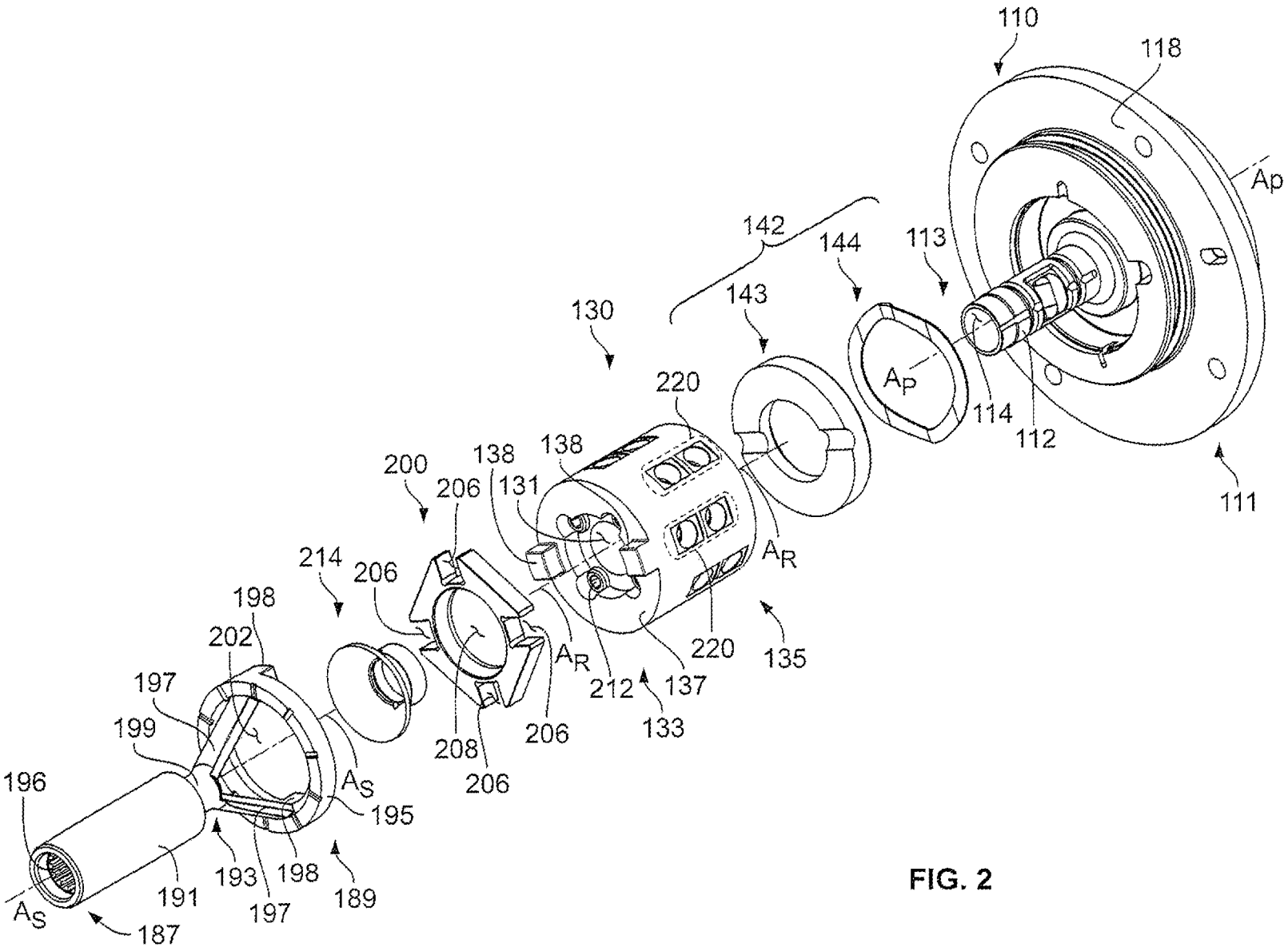
FIG. 2 is an expanded view of the radial piston device of FIG. 1 with a housing removed.
Figure 4:
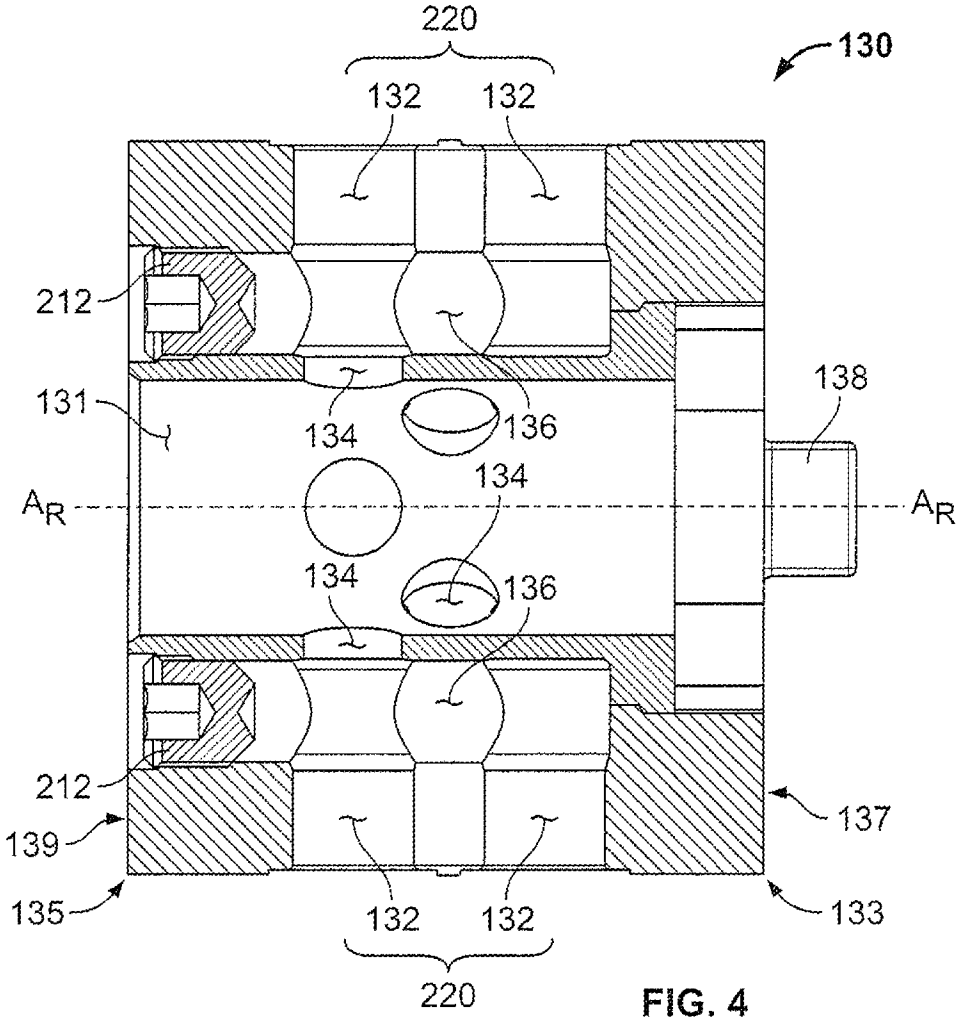
FIG. 4 is a cross-sectional view of an exemplary rotor.
Figure 3:
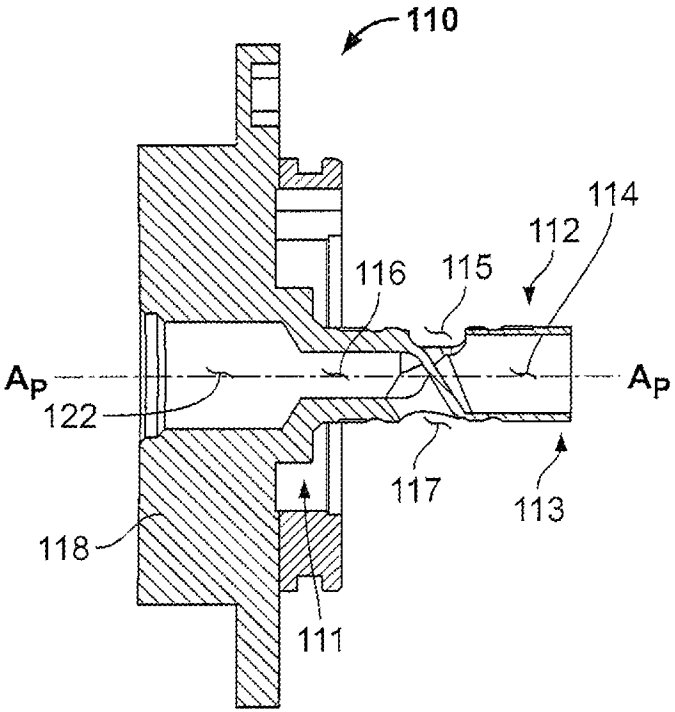
FIG. 3 is a cross-sectional view of an exemplary pintle.
Figure 5:
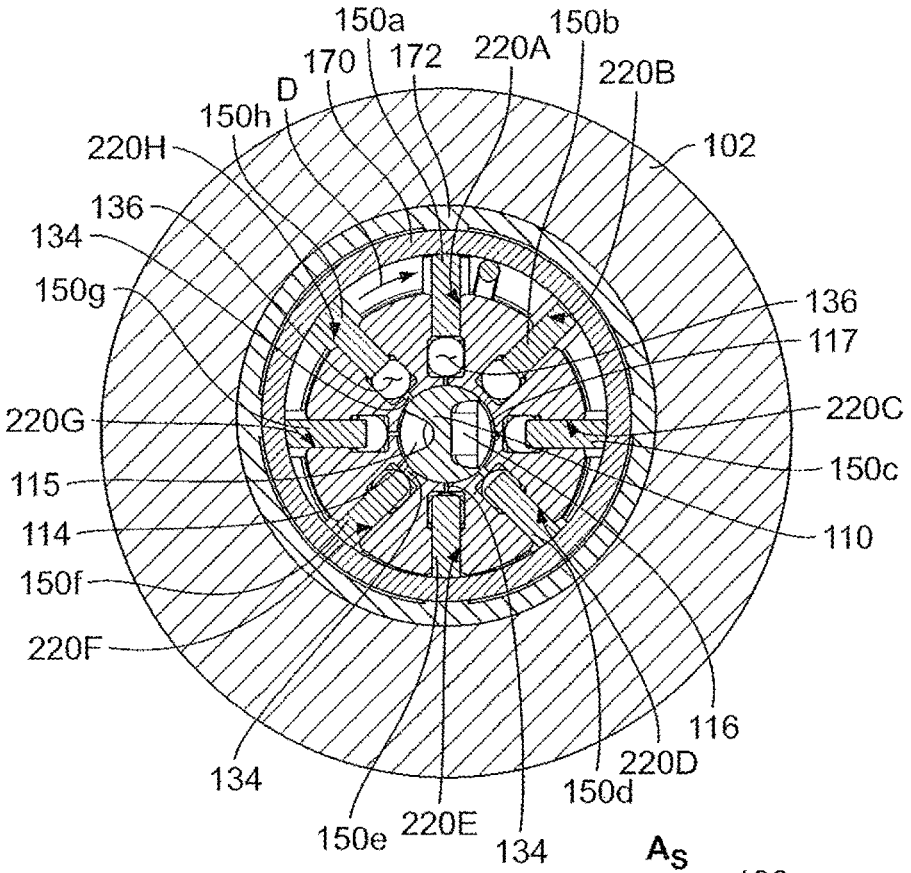
FIG. 5 is an end sectional view of the radial piston device of FIG. 1 with the housing removed.

FIGS. 1-5 illustrate a radial piston device 100 according to one example of the present disclosure. FIG. 1 is a side sectional view of an exemplary radial piston device. FIG. 2 is an expanded view of the radial piston device 100 of FIG. 1 with a housing removed. FIG. 3 is a cross-sectional view of an exemplary pintle. FIG. 4 is a cross-sectional view of an exemplary rotor. FIG. 5 is an end sectional view of the radial piston device of FIG. 1 with the housing removed.

In some examples, the radial piston device 100 includes a housing 102, a pintle 110, a rotor 130, a thrust washer 142, a plurality of pistons 150, a thrust ring 170, and a drive shaft 190. The radial piston device 100 may be used as a pump or a motor. When the device 100 operates as a pump, torque is input to the drive shaft 190 to rotate the rotor 130. When the device 100 operates as a motor, torque from the rotor 130 is output through the drive shaft 190. In this disclosure, the device 100 is primarily described as a pump. It is apparent, however, that the same principles and concepts are applicable to the device 100 being used as a motor.

Referring to FIG. 1, in some examples, the housing 102 includes a hydraulic fluid inlet 108 and an inlet chamber 109. The hydraulic fluid inlet 108 provides a passage through which hydraulic fluid is drawn into the housing 102 when the device 100 operates as a pump. The inlet chamber 109 is arranged between the pintle 110 (e.g., a pintle shaft 112) and the hydraulic fluid inlet 108 to provide a fluid communication therebetween. In some examples, the inlet chamber 109 is configured to provide a fluid passage for hydraulic fluid from the hydraulic fluid inlet 108 to the pintle 110 (e.g., the pintle shaft 112), and the drive shaft 190 is at least partially exposed to the inlet chamber 109 so that the hydraulic fluid flows over a portion of the drive shaft 190 before entering into the pintle 110 (e.g. the pintle shaft 112). The hydraulic fluid inlet 108 is arranged to be in fluid communication with the inlet chamber 109 along an inlet axis $A_I$. In some examples, the inlet axis $A_I$ is substantially perpendicular to a pintle axis $A_P$ along which hydraulic fluid is drawn into the pintle 110 (e.g., the pintle shaft 112). In some examples, the housing 102 may be configured as a two-part housing, as described with reference to FIGS. 14-15.

Referring to FIGS. 1-3, the pintle 110 has a first end 111 (also referred to herein as an outlet end) and a second end 113 (also referred to herein as an inlet end) that is opposite to the first end 111 along a pintle axis $A_P$. The pintle 110 includes a pintle shaft 112 that protrudes from the first end 111 of the pintle 110 along the pintle axis $A_P$ so that the pintle axis $A_P$ extends through a length of the pintle shaft 112. The pintle shaft 112 has a cantilevered configuration and includes a base end positioned adjacent the first end 111 of the pintle 110 and a free end positioned adjacent the second end 113.

In some examples, as shown in FIG. 1, the pintle 110 is partially accommodated within the housing 102 and fixed to the housing 102 at the first end 111 of the pintle 110. The pintle 110 includes a mounting flange 118 at the first end 111 of the pintle 110, and the mounting flange 118 is attached to the housing 102 via fasteners (not shown). In other examples, the pintle 110 is entirely accommodated within the housing 102 and fixed to the housing 102. Such an alternative configuration is described below with reference to FIGS. 14-15.

The pintle shaft 112 defines a pintle inlet 114 and a pintle outlet 116 therethrough. The pintle inlet 114 and the pintle outlet 116 are substantially aligned with the pintle axis $A_P$. The pintle inlet 114 is in fluidic communication with the hydraulic fluid inlet 108 through the inlet chamber 109, and the pintle outlet 116 is in fluidic communication with the hydraulic fluid outlet 122.

The pintle 110 may further include an inlet port 115 and an outlet port 117. The inlet port 115 and the outlet port 117 are formed on the pintle shaft 112. In some examples, the inlet port 115 is arranged substantially opposite to the outlet port 117 on the pintle shaft 112. The inlet port 115 is configured to be in fluid communication with the pintle inlet 114, and the outlet port 117 is configured to be in fluid communication with the pintle outlet 116.

In some examples, as shown in FIGS. 1-3, the pintle 110 includes a hydraulic fluid outlet 122 through which the hydraulic fluid is discharged after compressed within the device 100 when the device 100 operates as a pump. In other examples, the hydraulic fluid outlet 122 is arranged in the housing 102. Such an alternative configuration is described below with reference to FIGS. 14-15.

Referring to FIGS. 1, 2, and 4, the rotor 130 defines a pintle bore 131 that allows the rotor 130 to be mounted on the pintle shaft 112. The rotor 130 has an inlet end 133 and an outlet end 135 that is opposite to the inlet end 133 along a rotor axis $A_R$. The rotor axis $A_R$ extends through the length of the pintle shaft 112 and is coaxial with the pintle axis $A_P$. The rotor 130 is mounted on the pintle shaft 112 so that the outlet end 135 of the rotor 130 is arranged adjacent the first end 111 of the pintle 110 (which is adjacent the mounting flange 118). The inlet end 133 of the rotor 130 is coupled to the drive shaft 190 as explained below.

The rotor 130 is configured to rotate relative to the pintle 110 on the pintle shaft 112 about the rotor axis $A_R$. The rotor 130 defines a number of radial cylinders 132, each of which receives a piston 150 (FIG. 1). In the depicted example, the cylinders 132 are in paired configurations such that two cylinders 132 are located adjacent each other along a linear axis parallel to the rotor axis $A_R$. In the present application, such linearly-aligned cylinders 132 and pistons 150 are referred to as cylinder sets 220 and piston sets, respectively.

The rotor 130 includes a plurality of rotor fluid ports 134 configured to provide a fluid passage either between the pintle inlet 114 and the cylinder set 220 or between the cylinder set 220 and the pintle outlet 116, depending on a position of the rotor 130 relative to the pintle shaft 112. In some examples, the rotor 130 further includes common fluid chambers 136. Each of the common fluid chambers 136 corresponds to each cylinder set 220 and is arranged below each cylinder set 220. The common fluid chamber 136 is configured to bridge all cylinders 132 of the cylinder set 220 and provide a fluid communication between all the cylinders 132 and the corresponding rotor fluid port 134. For example, the common fluid chamber 136 is in fluidic communication with both cylinders 132 of each cylinder set 220. Thus, two cylinders 134 in each cylinder set 220 are bridged by a corresponding fluid chamber 136 so that the two cylinders 134 are in fluid communication with each other.

As such, each rotor fluid ports 134 is arranged adjacent each cylinder set 220 and configured to open both cylinders 132 of each cylinder set 220 to either the pintle inlet 114 through the inlet port 115 or the pintle outlet 116 through the outlet port 117. Each of the rotor fluid ports 134 is alternatively in fluid communication with either the pintle inlet 114 through the inlet port 115 of the pintle 110 or the pintle outlet 116 through the outlet port 117 of the pintle 110, depending on a rotational position of the rotor 130 relative to the pintle 110 about the rotor axis $A_R$. Accordingly, the rotor fluid ports 134 permit for fluidic communication between each cylinder set 220 and either the pintle inlet 114 or the pintle outlet 116.

In some examples, the common fluid chambers 136 are cross-drilled holes having open ends. The open ends are blocked with sealing members 212 to seal the chambers 136. Examples of the sealing members 212 include set screws, common plugs, Welch plugs, brazed plugs, mechanically locked plug pins (i.e., Lee plugs), cast-in plugs, and weldments.

In some examples, all common fluid chambers 136 extend from a rotor inlet face 137. In other examples, all common fluid chambers 136 extend from a rotor outlet face 139. In either configuration, the common fluid chambers 136 are sealed with the sealing members 212 from either the rotor inlet face 137 or the rotor outlet face 139. In some examples, the common fluid chambers 136 are formed by drilling the rotor 30 in an axial direction parallel with the rotor axis $A_R$.

In yet other examples, some of the common fluid chambers 136 extend from the rotor inlet face 137, and the others extend from the rotor outlet face 139. In this configuration, the common fluid chambers 136 formed from the rotor inlet face 137 are sealed by the sealing members 212 from the rotor inlet face 137, and the common fluid chambers 136 formed from the rotor outlet face 139 are sealed by the sealing members 212 from the rotor outlet face 139. This configuration is described below in further detail with reference to FIGS. 12 and 13.

Referring to FIG. 1, the thrust washer 142 is configured to provide an axial thrust force to bias the rotor 130 and the drive shaft 190 toward the drive shaft end of the housing 102. This alleviates potential tolerance stack error between the rotor 130 and the thrust ring 170. Further, the flexibility of the thrust washer 142 prevents binding of the rotating assembly including the rotor 130 and the drive shaft 190 due to thermal growth, as well as supports the rotor 130 in the event of external vibration or shock loading as expected in aerospace applications.

In some examples, the thrust washer 142 includes a bearing plate 143 and a thrust plate 144. The bearing plate 143 is arranged to contact the rotor outlet face 135 of the rotor 130 and provide a bearing surface for the rotor 130 to rotate against. In some examples, the bearing plate 143 is secured to the pintle 110, such as the mounting flange 118 of the pintle 110. The thrust plate 144 is engaged between the bearing plate 143 and the pintle 110, such as the mounting flange 118 of the pintle 110, and operates to generate a thrust force against the bearing plate 143 along the pintle axis $A_P$.

Referring to FIG. 1, the pistons 150 are received in the radial cylinders 132 defined in the rotor 130 and displaceable in the radial cylinders 132, respectively. Each piston 150 is in contact with the thrust ring 170 at a head portion of the piston 150.

Referring to FIG. 1, the thrust ring 170 is supported radially by the housing 102 and rotatably mounted in the housing 102. The thrust ring 170 may be supported with a hydrodynamic journal bearing 172.

Referring to FIGS. 1 and 2, the drive shaft 190 is at least partially located within the housing 102. An oil seal assembly 192 surrounds the drive shaft 190 and prevents hydraulic fluid from inadvertently exiting the housing 102. The drive shaft 190 is supported with a plurality of alignment bushings 194 to minimize radial load on the drive shaft 190.

The drive shaft 190 has a driving end 187 and a power transfer end 189, which is opposite to the driving end 187 along a drive shaft axis of rotation $A_S$. In some examples, the drive shaft 190 includes a shaft body 191, a stem 193 and a power transfer flange 195.

The shaft body 191 is configured to be engaged with a driving mechanism (not shown) at the driving end 187 of the drive shaft 190 so that torque is input to the drive shaft 190 to rotate the rotor 130 when the radial piston device 100 operates as a pump. In some examples, the drive shaft 190 includes a number of drive splines 196 at the shaft body 191 of the drive shaft 190. In some examples, the drive splines 196 are formed within the shaft body 191. In other examples, the splines may be arranged on an outer surface of the shaft body 191.

A power transfer flange 195 is configured to be engaged with the rotor 130 at the rotor inlet end 133. The power transfer flange 195 defines a flow passage 202 that allow hydraulic suction flow to pass into the pintle inlet 114 of the pintle shaft 112. In some examples, the drive shaft flow passage 202 may include a tapered or funneled inner surface 204 (FIG. 6) that reduces pressure losses as the hydraulic fluid is drawn into the pintle inlet 114.

The stem 193 extends between the shaft body 191 and the power transfer flange 195. In some examples, the drive shaft 190 is located within the housing 102 such that hydraulic fluid entering the housing 102 via the hydraulic fluid inlet 108 flows around a portion of the drive shaft 190 and into the pintle inlet 114 of the pintle shaft 112. For example, the stem 193 of the drive shaft 190 is exposed at the inlet chamber 109 so that hydraulic fluid entering the housing 102 through the hydraulic fluid inlet 108 flows over at least the stem 193 before drawn into the pintle inlet 114 of the pintle shaft 112.

Referring to FIG. 5, the operation of the radial piston device 100 is described. As depicted, the rotor axis $A_R$ is aligned with the pintle axis $A_P$, but the rotor axis $A_R$ and the pintle axis $A_P$ are not coaxial with a thrust ring axis of rotation. The plurality of pistons 150 reciprocate radially within the rotor 130 as the rotor 130 rotates about the pintle shaft 112 to draw fluid into the cylinders during outward strokes of the pistons and to force fluids from the cylinders during inward strokes of the pistons. Reciprocation of the pistons 150 occurs due to a radial offset (i.e., eccentricity) between the thrust ring 170 and the rotor 130. As a result, the pistons 150 pump once per revolution of the rotor 130 (i.e., the pistons move through one in-stroke and one out-stroke per revolution of the rotor). As shown in FIG. 5, piston 150*a* is located at top dead center (TDC) position (the full out-stroke position) and piston 150*e* is located at bottom dead center (BDC) position (the full in-stroke position). In some examples, when the rotor 130 is in a position as illustrated in FIG. 5, the rotor fluid ports 134 for the cylinder sets 220F, 220G and 220H are in fluidic communication with the pintle inlet 114. In the same position of the rotor 130, the rotor fluid ports 134 for the cylinder sets 220B, 220C and 220D, which are located opposite to the cylinder sets 220F, 220G and 220H, respectively, are in fluidic communication with the pintle outlet 116. In this position, when the device 100 is operated as a pump and the rotor 130 is rotated by the drive shaft in a direction D, hydraulic fluid is drawn from the hydraulic fluid inlet 108 and flows into the rotor fluid ports 134 for the cylinder sets 220F, 220G and 220H, as the piston sets 150*f*, 150*g* and 150*h* move radially outward in the associated cylinder sets due to the interaction between the rotor 130 and the thrust ring 170 and centrifugal action. Concurrently, hydraulic fluid is forced from the cylinder sets 220B, 220C and 220D through the corresponding rotor fluid ports 134 and discharged to the hydraulic fluid outlet 122 via the pintle outlet 116 as the pistons sets 150*b*, 150*c* and 150*d* move radially inwardly due to interaction between the rotor 130 and the thrust ring 170.

The interface between the pistons 150 and the inner race of the thrust ring 170 is defined by a spherical piston geometry and raceways formed on the inner race of the thrust ring. This promotes rolling of the pistons 150 on the thrust ring 170 in order to prevent sliding. The thrust ring 170 also rotates as the pistons 150 roll on the thrust ring 170. An even number of cylinder sets are used in order to balance the thrust loads acting on the thrust ring 170. In the depicted example, eight cylinder sets are utilized. Special materials or coatings (such as ceramics or nanocoatings) can be used to decrease the friction and increase the longevity of the piston/ring interface.

Referring to FIGS. 1 and 2, the device 100 can further include a flexible coupling 200 configured to engage the rotor 130 with the drive shaft 190. In some examples, the drive shaft 190 is connected to the inlet end of the rotor 130 at the flexible coupling 200. For example, the power transfer flange 195 of the drive shaft 190 may be connected to the inlet end of the rotor 130 with the flexible coupling 200 therebetween.

In some examples, the power transfer flange 195 includes a number of shaft teeth 198 to engage the flexible coupling 200. In this example, two shaft teeth 198 engage the flexible coupling 200 at an angle of about 90 degrees from two rotor teeth 138 that also engage the flexible coupling 200.

The flexible coupling 200 defines a number of receivers 206 for receiving the shaft teeth 198 and the rotor teeth 138. The flexible coupling 200 defines a coupling flow passage 208 to direct the hydraulic suction flow into the pintle inlet 114. Use of the flexible coupling 200 allows for misalignment between the rotor axis $A_R$ and the drive shaft axis $A_S$. This misalignment prevents radial loading of the drive shaft 190, and allows the rotor 130 to float freely on the pintle journal bearings.

The radial piston device 100 may include several mechanisms for reducing the pressure loss of hydraulic fluid flowing into the pintle shaft 112. The mechanisms are hereinafter explained in detail with reference to FIGS. 6-20. In some examples, each of the mechanisms may be separately implemented in a radial piston device. In other examples, any combination of the mechanisms may be used for the radial piston device. The mechanisms are configured to minimize a pressure drop of hydraulic fluid flow before entering the pintle inlet, thereby reducing the size of a booster pump that is arranged upstream of the radial piston device to compensate the pressure drop of the hydraulic fluid. Accordingly, the power density of the device can also be improved.

Figure 6:
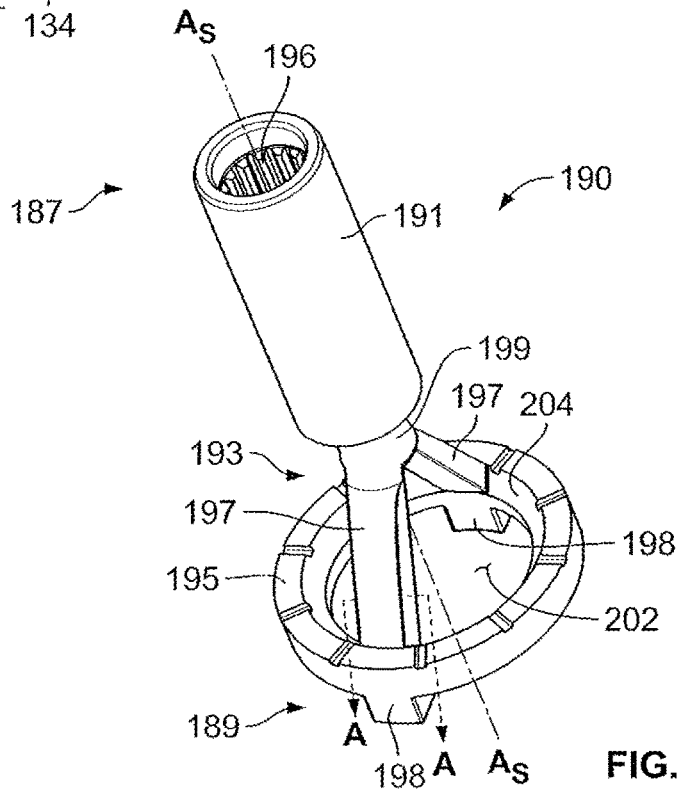
FIG. 6 is a perspective view of an exemplary drive shaft.
Figure 7:
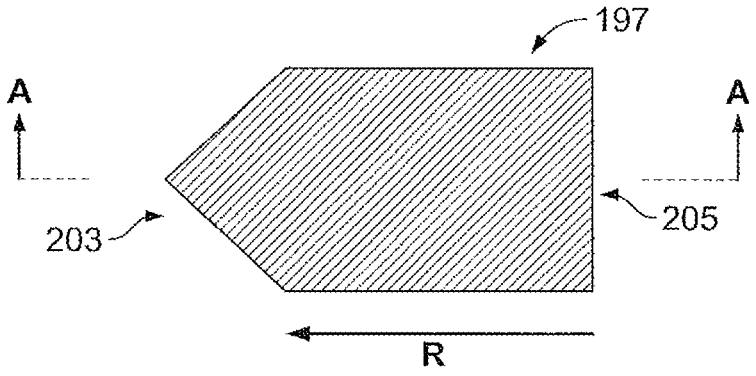
FIG. 7 is a cross-sectional view of an exemplary arm of the drive shaft of FIG. 6.

FIGS. 6 and 7 illustrate an exemplary drive shaft 190. In particular, FIG. 6 is a perspective view of an exemplary drive shaft. FIG. 7 is a cross-sectional view of an exemplary arm of the drive shaft of FIG. 6. As the concepts and features are similar to the drive shaft 190 as shown in FIGS. 1 and 2, the same reference numbers are used for the same or similar features or elements, and the description for the drive shaft 190 in FIGS. 6 and 7 is omitted for brevity purposes. The following description will be limited primarily for the differences between the drive shaft 190 shown in FIGS. 6 and 7 and the drive shaft 190 shown in FIGS. 1-7.

In some examples, the stem 193 includes a plurality of arms 197. The arms 197 extend from the power transfer flange 195 toward the shaft body 191 above the drive shaft flow passage 202. The arms 197 have portions radially offset from the shaft axis of rotation $A_S$. In some examples, the arms 197 are configured to be angled away from the shaft axis of rotation $A_S$ as the arms 197 extend from the power transfer flange 195.

The arms 197 can extend from a portion of the periphery of the power transfer flange 195. In the depicted example, the arms 197 extend from the tapered inner surface 204 of the power transfer flange 195. In other examples, the stem 193 can have one arm 197 extending from the power transfer flange 195 toward the shaft body 191.

In some examples, the arms 197 extending from the power transfer flange 195 are connected to an arm connection point 199. The arm connection point 199 is connected to the shaft body 191. In other examples, the arm connection point 199 is part of the shaft body 191. The arm connection point 199 is arranged to be axially offset from a plane or surface of the drive shaft flow passage 202 toward the shaft body 191. As shown in FIG. 1, the arm connection point 199 is arranged within the inner chamber 109 of the housing 102 so that the arms 197 are exposed to hydraulic fluid entering through the hydraulic fluid inlet 108. For example, the stem 193 includes two arms 197 that extend from the power transfer flange 195 toward the shaft body 191 and are connected at the arm connection point 199. In some examples, the two arms 197 are symmetrically arranged about the drive shaft axis $A_S$ (i.e., equally circumferentially spaced-apart). As such, the stem 193 is configured as a Y-shape stem.

In some examples, the stem 193 is configured such that the inlet axis $A_I$ of the hydraulic fluid inlet 108 is arranged between the arm connection point 199 of the stem 193 and the power transfer flange 195. In this configuration, the drive shaft flow passage 202 defined by the power transfer flange 195 is entirely opened to the pintle inlet 144 of the pintle shaft 112. Further, the Y-shape of the arms 197 can reduce a chance that the stem 193 interferes with hydraulic fluid flowing from the hydraulic fluid inlet 108 to the pintle inlet 114 of the pintle shaft 112. For example, the Y-shape configuration of the stem 193 can shift a low pressure region of hydraulic fluid, which can be created by a vortex of the hydraulic fluid drawn from the hydraulic fluid inlet 108, away from the drive shaft flow passage 202 (and the pintle inlet 114) within the inlet chamber 109. Such a shift of the low pressure region is particularly advantageous because it allows the hydraulic fluid to regain its pressure as the fluid moves toward the pintle inlet 114 through the drive shaft flow passage 202.

As shown in FIG. 7, the arms 197 can have a cross-section having a leading edge 203 and a trailing edge 205. The leading edge 203 is arranged ahead of the trailing edge 205 in a rotational direction R of the drive shaft 190. In some examples, the leading edge 203 of the arms 197 is configured to reduce resistance to a rotational movement of the stem 193 through hydraulic fluid within the inlet chamber 109. For example, as shown in FIG. 7, the leading edge 203 of the arms 197 is streamlined to have an apex. In some examples, the leading edge 203 has a tapered configuration. In some examples, the trailing edge 205 is not streamlined.

Figure 8:
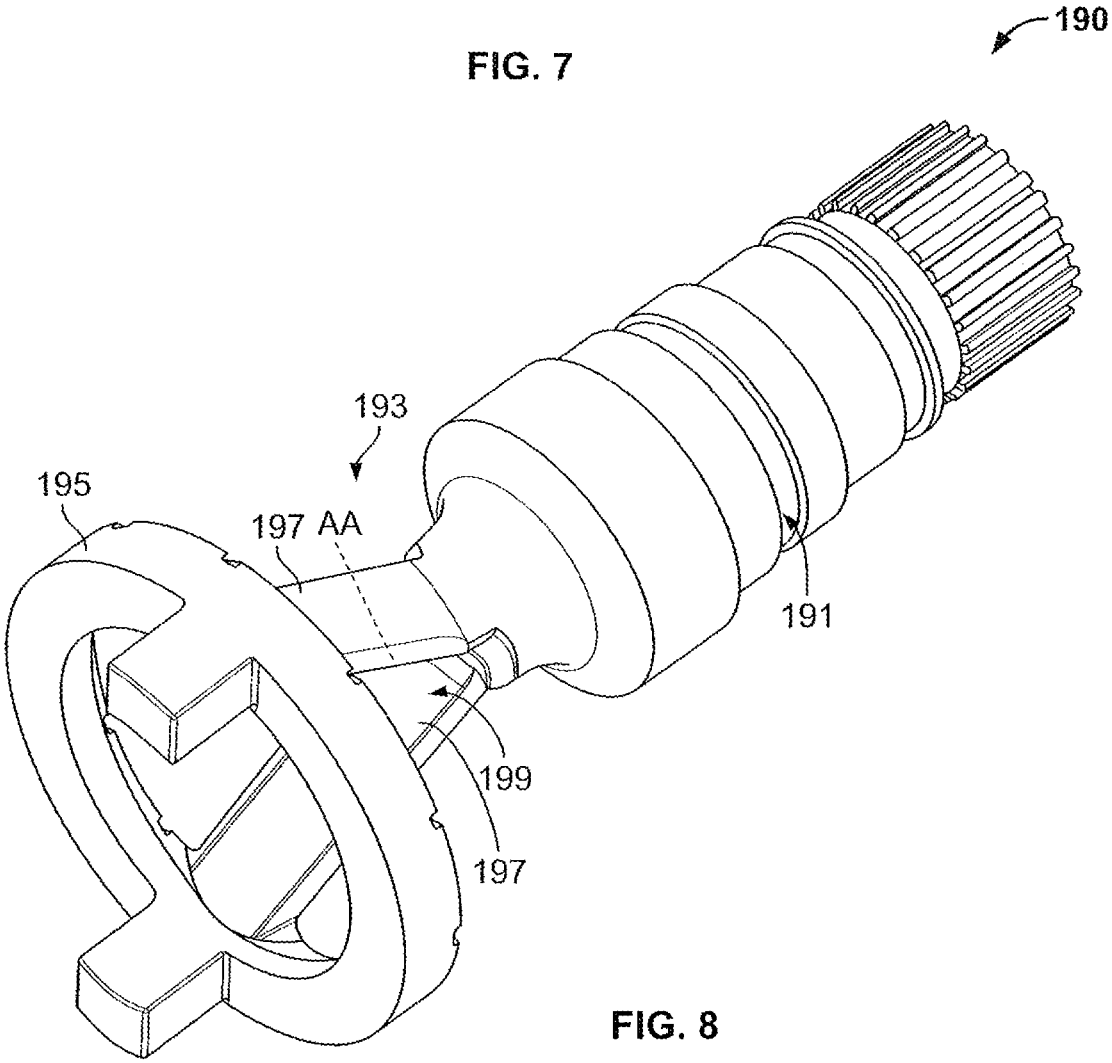
FIG. 8 is a perspective view of a drive shaft according to one example of the present disclosure.
Figure 9:
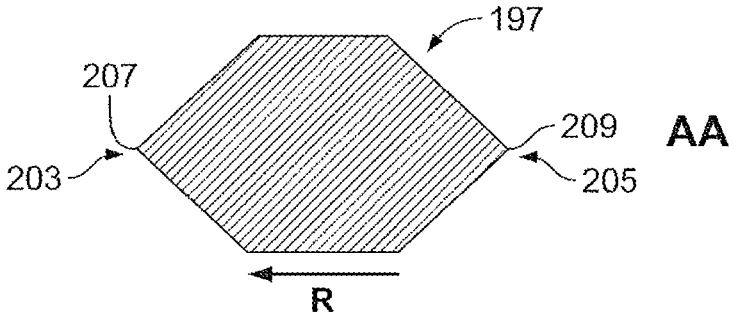
FIG. 9 is a cross-sectional view of an exemplary arm of the drive shaft of FIG. 8.

FIGS. 8 and 9 illustrate another exemplary drive shaft 190 configured to minimize a pressure loss of hydraulic fluid flowing on the drive shaft 190. In particular, FIG. 8 is a perspective view of a drive shaft 190 according to one example of the present disclosure. FIG. 9 is a cross-sectional view of an arm of the drive shaft 190 of FIG. 8. As the concepts and features are similar to the drive shaft 190 as shown in FIGS. 1, 2, 6, and 7, the same reference numbers are used for the same or similar features or elements, and the description for the drive shaft 190 in FIG. 8 is omitted for brevity purposes.

Referring to FIG. 9, both the leading edge 203 and the trailing edge 205 of the arms 197 is configured to reduce resistance to a rotational movement of the stem 193 through hydraulic fluid within the inlet chamber 109. In some examples, similarly to FIG. 7, the leading edge 203 of the arms 197 is streamlined (e.g., tapered) to have an apex 207. In this example, the trailing edge 205 is also streamlined to have an apex 209. In other examples, the leading edge 203 and/or the trailing edge 205 can have a different shape suitable for reducing momentum imparted to hydraulic fluid as the drive shaft 190 rotates within the fluid. This configuration of the arms 197 with a streamlined cross-section can avoid excessive churning of hydraulic fluid in the inlet chamber 109, which would otherwise cause a significant pressure loss of the fluid before entering the pintle inlet 114 of the pintle shaft 112. The streamlined shapes of the trailing edge 205 as well as the leading edge 203 of the arm 197 are particularly advantageous for a radial piston pump with a large capacity or size.

Figure 10:
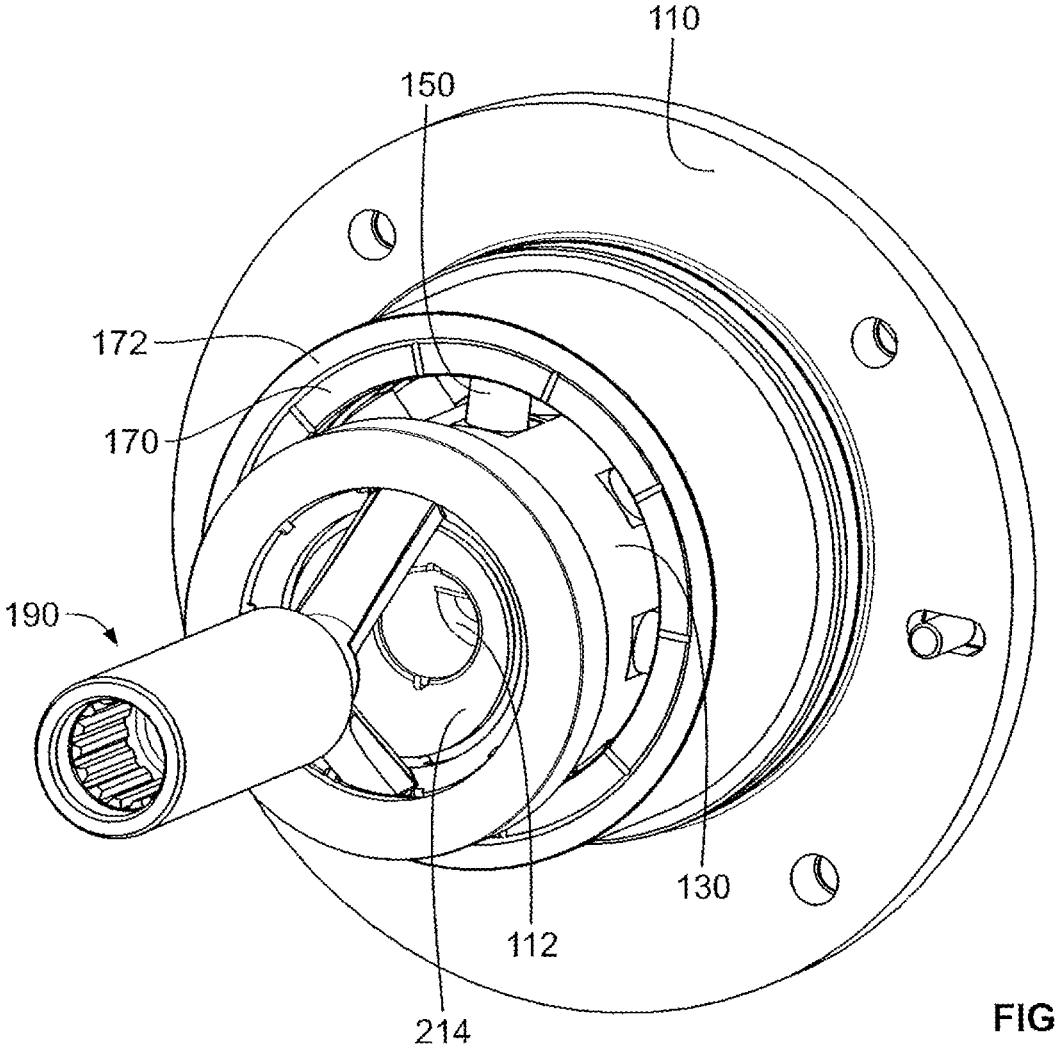
FIG. 10 is a perspective view of an exemplary radial piston device with a housing removed, illustrating an exemplary funnel assembled to the device of FIG. 1.
Figure 11:
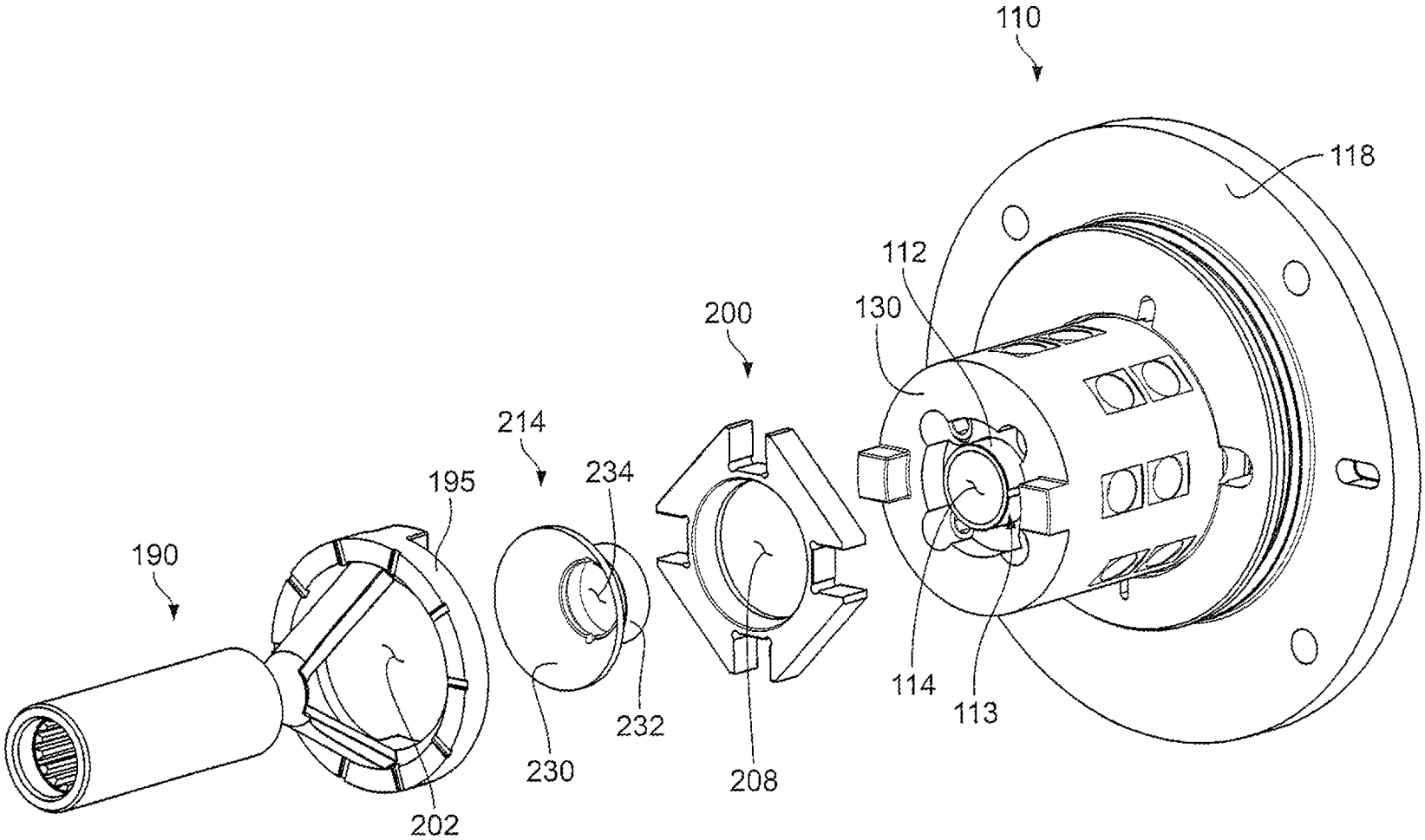
FIG. 11 is an expanded view of the radial piston device with the housing removed, illustrating the funnel of FIG. 10.

FIGS. 10 and 11 illustrate an exemplary funnel 214 configured to minimize a pressure loss of hydraulic fluid flowing into the pintle shaft 112. In particular, FIG. 10 is a perspective view of an exemplary radial piston device 100 with a housing 102 removed, illustrating an exemplary funnel 214 assembled to the device 100. FIG. 11 is an expanded view of the radial piston device 100 with the housing 102 removed, illustrating the funnel 214 of FIG. 10.

As also shown in FIGS. 1 and 2, the device 100 can further include a funnel 214. The funnel 214 operates to stabilize and guide a flow of hydraulic fluid delivering from the inlet chamber 109 to the pintle inlet 114 through the drive shaft flow passage 202 while the drive shaft 190 and the rotor 130 rotate about the drive shaft axis $A_S$ and the rotor axis $A_R$. The funnel 214 is configured to prevent rotating components, such as the rotor 130, the power transfer flange 195, and the flexible coupling 200, from being exposed directly to the hydraulic fluid flowing from the inlet chamber 109 to the pintle inlet 114. In some examples, the funnel 214 is secured to the pintle shaft 112 at the inlet end or second end 113 and does not rotate with the rotating components. In some examples, the funnel 214 is fixed to the pintle shaft 112 so that the funnel 214 remains stationary as the drive shaft 190 and the rotor 130 rotates. Therefore, the funnel 214 can prevent hydraulic fluid from swirling around rotating components including the power transfer flange 195 and the flexible coupling 200 as the hydraulic fluid is drawn into the pintle shaft 112. By stabilizing the hydraulic fluid flow into the pintle shaft 112, a pressure loss of the hydraulic fluid can be reduced.

As shown in FIG. 11, the funnel 214 includes a flow guiding portion 230 and a coupling portion 232. The coupling portion 232 defines a funnel outlet passage 234 for providing a fluid communication between the drive shaft fluid passage 202 and the pintle inlet 114. The coupling portion 232 is configured to be secured to the second end 113 of the pintle shaft 112. In some examples, the coupling portion 232 is screwed onto an outer surface of the pintle shaft 112 at the second end 113 thereof. Alternatively, the coupling portion 232 can be screwed onto an inner surface of the pintle shaft 112 at the second end 113 thereof. In other examples, the coupling portion 232 can be connected to the pintle shaft 112 in any manner, such as by fasteners or welding.

In some examples, the flow guiding portion 230 of the funnel 214 is configured as a conical shape. The flow guiding portion 230 is connected to the coupling portion 232 at one end, and is configured to be open to the drive shaft fluid passage 202 at the other end. In some examples, the flow guiding portion 230 is configured to be at least partially inserted into the drive shaft fluid passage 202 and occupy substantially the entire dimension of the drive shaft fluid passage 202, thereby guiding substantially the whole hydraulic fluid passing through the drive shaft fluid passage 202 into the pintle inlet 114. The flow guiding portion 230 is also configured to be inserted into the coupling flow passage 208 of the flexible coupling 200 such that the flexible coupling 200 freely rotates around the flow guiding portion 230 of the funnel 214.

Figure 12:
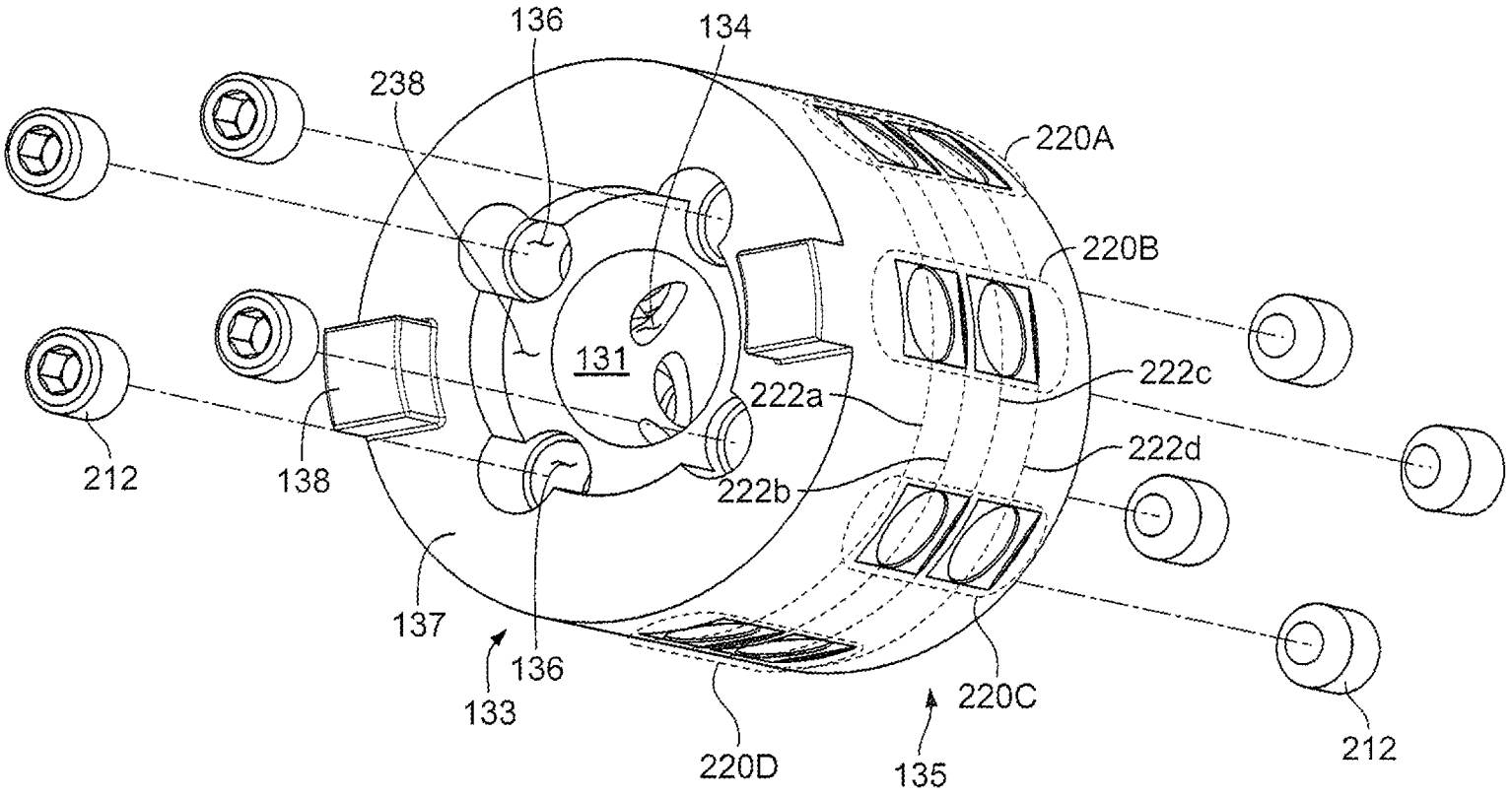
FIG. 12 is a front perspective view of a rotor according to one example of the present disclosure.
Figure 13:
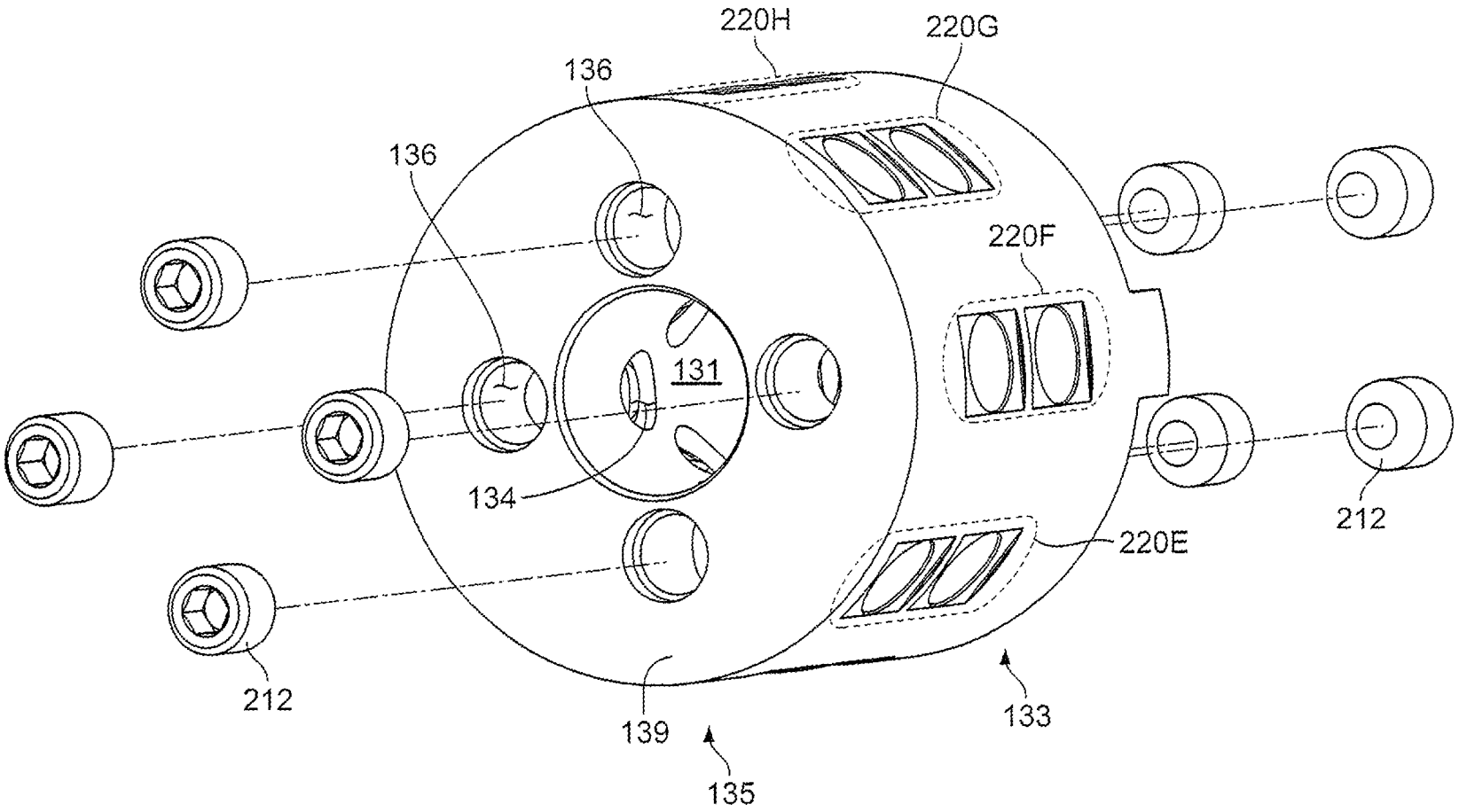
FIG. 13 is a rear perspective view of the rotor of FIG. 12.

FIGS. 12 and 13 illustrates an exemplary rotor 130 used with the funnel 214 of FIG. 11. In particular, FIG. 12 is a front perspective view of a rotor 130 according to one example of the present disclosure, and FIG. 13 is a rear perspective view of the rotor 130 of FIG. 12. FIGS. 1, 2, and 4 are also referred to in describing the rotor 130 below.

As depicted, each cylinder set 220A is offset from an adjacent cylinder set 220B, such that four rows 222*a*, 222*b*, 222*c* and 222*d* are present on the rotor 130 (FIG. 12). The rows 222*a*, 222*b*, 222*c* and 222*d* extend in a circumferential direction about the rotor and are axially offset from one another. In general, axial offsetting the rows of cylinder sets 220, and of piston sets therein, around the rotor 130 allows the overall size of the rotor 130 (and therefore the device 100) to be reduced. Additionally, the offsetting of the cylinder/piston rows balances the thrust loads on the rotor that are generated due to contact between the thrust ring 170 and the pistons 150. In some examples, a minimum of two rows 222 are necessary to balance the thrust loads on the thrust ring. In other examples, other numbers of rows and shafts may be utilized. In this example, four piston rows 222*a*, 222*b*, 222*c* and 222*d* are utilized.

In some examples, the cylinder sets 220A-220H are alternately offset from one another. For examples, the cylinder sets 220A, 220C, 220E, and 220G are arranged closer to the outlet end 135 of the rotor 130 than to the inlet end 133 of the rotor 130, and the cylinder sets 220B, 220D, 220F, and 220H are arranged closer to the inlet end 133 than to the outlet end 135 of the rotor 130.

Referring to FIG. 12, the rotor 130 further includes a recess 238 formed around the pintle bore 131 on the rotor inlet end 133. The recess 238 is configured to receive at least a portion of the funnel 214 and provides a space sufficient for the funnel 214 to be coupled or secured to the pintle shaft 112 at the second end 113 thereof. Further, the recess 238 reduces the weight of the rotor 130, thereby increasing the power density of the device 100.

In some examples, all of the common fluid chambers 136 can be formed from the rotor inlet face 137 at the rotor inlet end 133. In this configuration, however, the common fluid chambers 136 that are arranged below the cylinder sets 220B, 220D, 220F, and 220H, which are closer to the rotor inlet end 133, may be partially cut out by the recess 238 formed on the rotor inlet face 137. In some examples, the shortened common fluid chambers 136 do not provide a sufficient space for the sealing members 212 to be engaged into the common fluid chambers 136 from the rotor inlet face 137. Further, the shortened common fluid chambers 136 may have an insufficient space for providing a proper fluid communication between the cylinders 132 and the corresponding rotor fluid port 134.

In the depicted example, the common fluid chambers 136 are formed from a rotor face, either the rotor inlet face 137 or the rotor outlet face 139 such that the common fluid chambers 136 are associated with the cylinder sets 220 that are arranged farther from the rotor face. For example, as shown in FIGS. 12 and 13, the common fluid chambers 136 associated with the cylinder sets 220A, 220C, 220E, and 220G are formed from the rotor inlet face 137 (FIG. 12), and the common fluid chambers 136 associated with the cylinder sets 220B, 220D, 220F, and 220H are formed from the rotor outlet face 139 (FIG. 13). This configuration allows the common fluid chambers 136 to have sufficient space for receiving the sealing members 212 although the recess 238 formed on the rotor inlet face 138 shortens an axial length of the rotor 130 that is to be used for the common fluid chambers 136.

Figure 14:
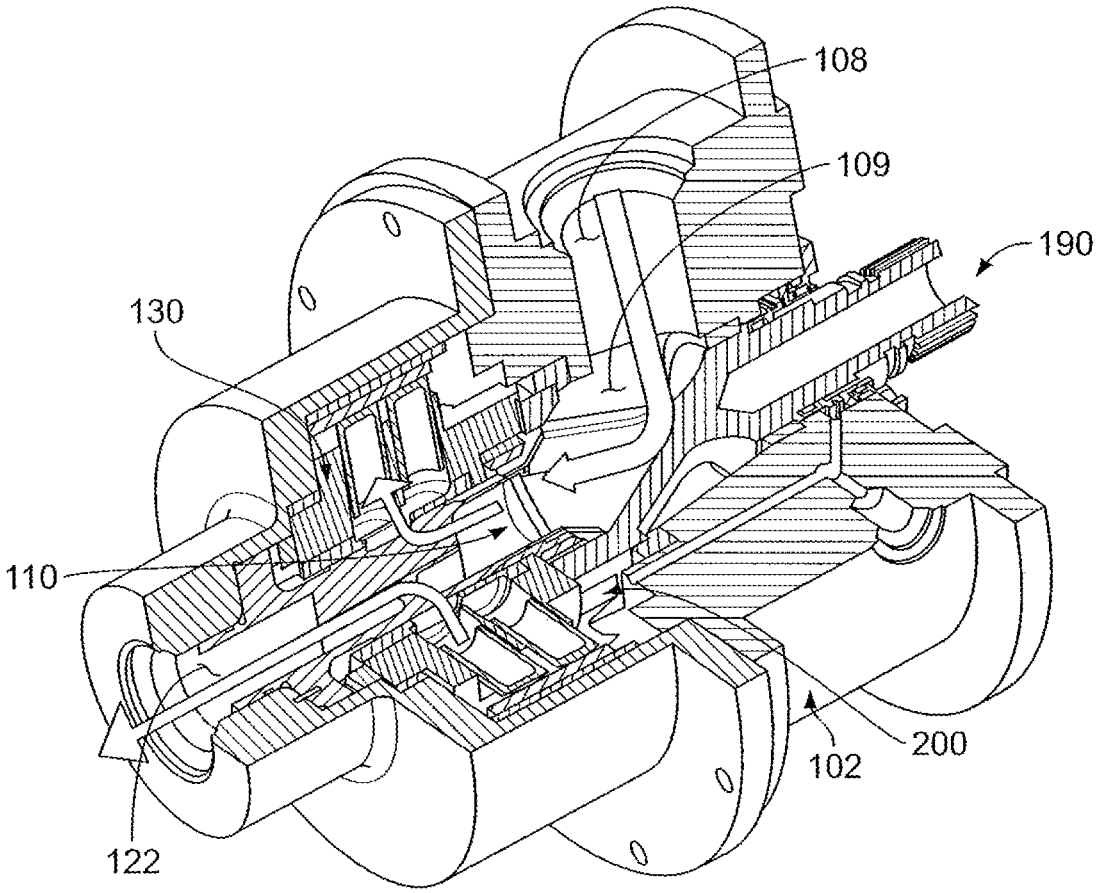
FIG. 14 is a partial sectional view of an exemplary radial piston device, illustrating an exemplary inlet chamber.
Figure 15:
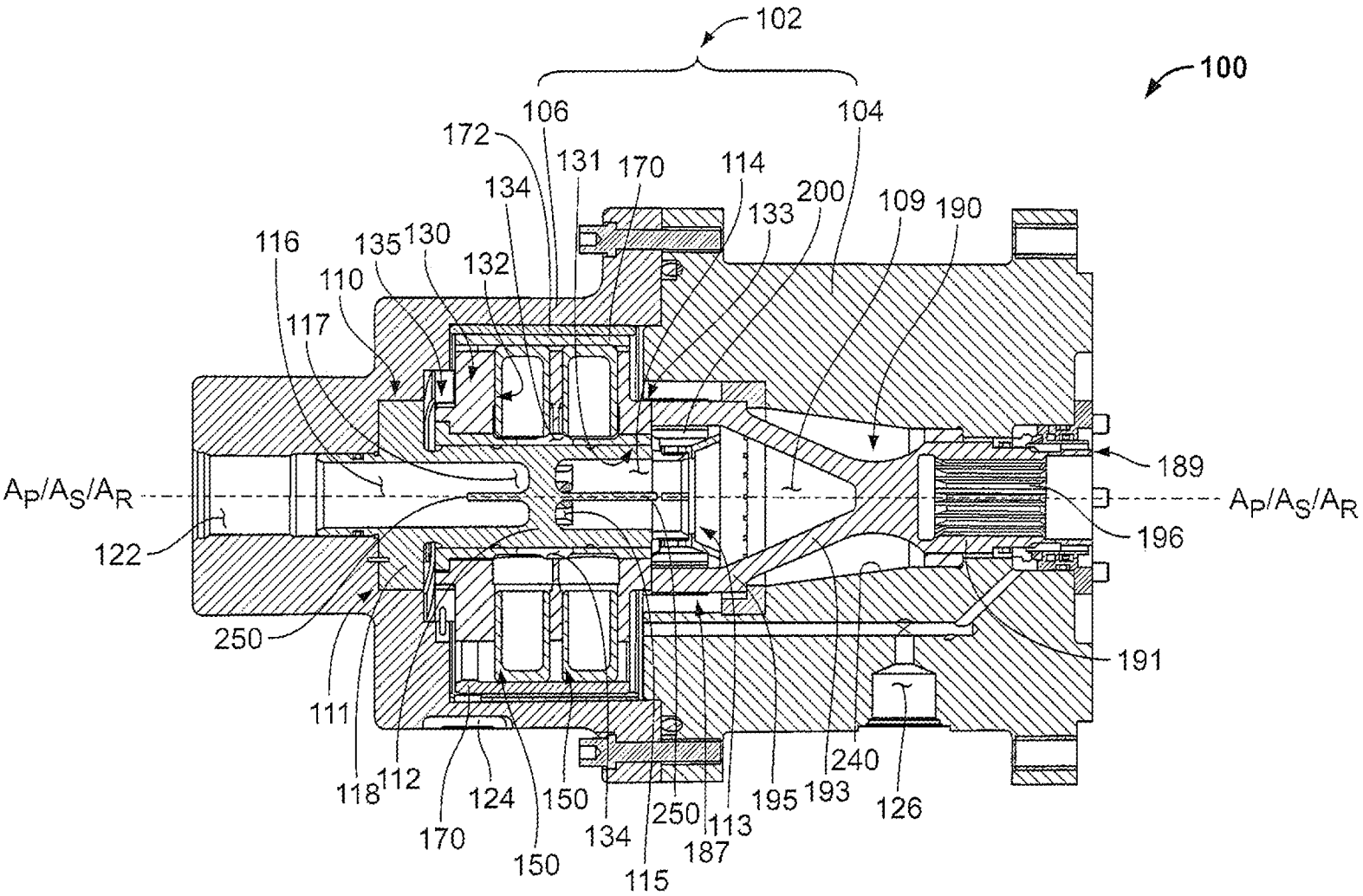
FIG. 15 is a cross-sectional view of the radial piston device of FIG. 14.
Figure 16:
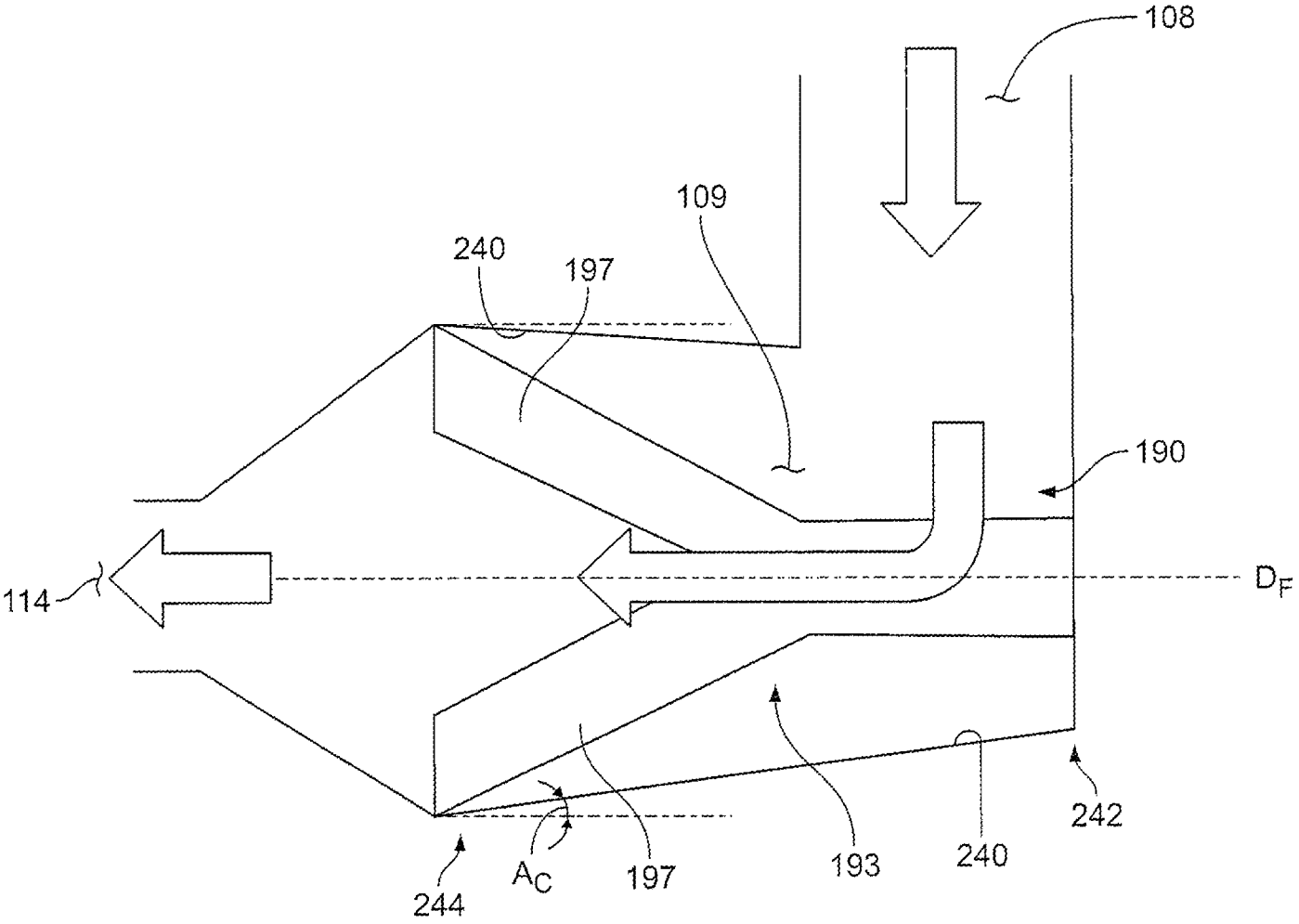
FIG. 16 is a schematic side cross-sectional view of the inlet chamber of FIG. 14.

FIGS. 14-16 illustrate an inlet chamber 109 according to one example of the present disclosure. In particular, FIG. 14 is a partial sectional view of an exemplary radial piston device 100, illustrating an exemplary inlet chamber 109. FIG. 15 is a cross-sectional view of the radial piston device 100 of FIG. 14. FIG. 16 is a schematic side cross-sectional view of the inlet chamber 109 of FIG. 14. The concepts and features of the radial piston device 100 shown in FIGS. 14 and 15 are similar to the device 100 shown in FIGS. 1-7. Thus, the same reference numbers are used for the same or similar features or elements, and the description for the same or similar features of elements is omitted for brevity purposes. The following description will be limited primarily for the differences between the device 100 shown in FIGS. 14 and 15 and the device 100 shown in FIGS. 1-5.

As shown in FIGS. 14 and 15, the housing 102 may be configured as a two-part housing that includes a drive shaft housing 104 and a rotor housing 106. The drive shaft housing 104 includes the hydraulic fluid inlet 108 through which hydraulic fluid is drawn into the drive shaft housing 104 when the device 100 operates as a pump. The rotor housing 106 includes the hydraulic fluid outlet 122 through which hydraulic fluid is discharged when the device 100 operates as a pump. In this example, the pintle 110 is accommodated within the rotor housing 106 and fixed to the rotor housing 106 at the first end 111 of the pintle 110. The mounting flange 118 of the pintle 110 is attached to the rotor housing 106 via fasteners (not shown). The thrust ring 170 is supported radially by the rotor housing 106 and rotatably mounted in the rotor housing 106. The drive shaft 190 is at least partially located within the drive shaft housing 104.

In some examples, the inlet chamber 109 has a first chamber end 242 and a second chamber end 244 opposite to the first chamber end 242 along the drive shaft axis $A_S$ (or a direction $D_F$ of hydraulic fluid flow in the inlet chamber). The second chamber end 244 is arranged adjacent the pintle inlet 114. The first chamber end 242 is located adjacent the hydraulic fluid inlet 108 of the housing 102.

In some examples, the inlet chamber 109 is tapered from the first chamber end 242 to the second chamber end 244 such that hydraulic fluid entering through the hydraulic fluid inlet 108 smoothly flows from the first chamber end 242 to the second chamber end 244 until it is drawn into the pintle inlet 114. For example, the inlet chamber 109 includes a side wall 240 extending between the first chamber end 242 and the second chamber end 244, and the side wall 240 forms a declined surface at an angle $A_C$ from the first chamber end 242 to the second chamber end 244. In some examples, such a declined surface is formed only a portion of the side wall 240 that substantially faces the hydraulic fluid inlet 108. In other examples, the inlet chamber 109 is configured to have a smaller cross-sectional area at the first chamber end than at the second chamber end. In still other examples, the inlet chamber 109 is configured to have a cross-sectional area that gradually increases in the direction $D_F$ of hydraulic fluid flow within the inlet chamber 109 (from the first chamber end 242 to the second chamber end 244). The tapered inlet chamber 109 reduces vortices of hydraulic fluid created by a rotation of the drive shaft 190 within the inlet chamber 109 as the hydraulic fluid flows from the first chamber end 242 to the second chamber end 244, thereby decreasing a pressure loss of the hydraulic fluid entering the pintle inlet 114.

Figure 17:
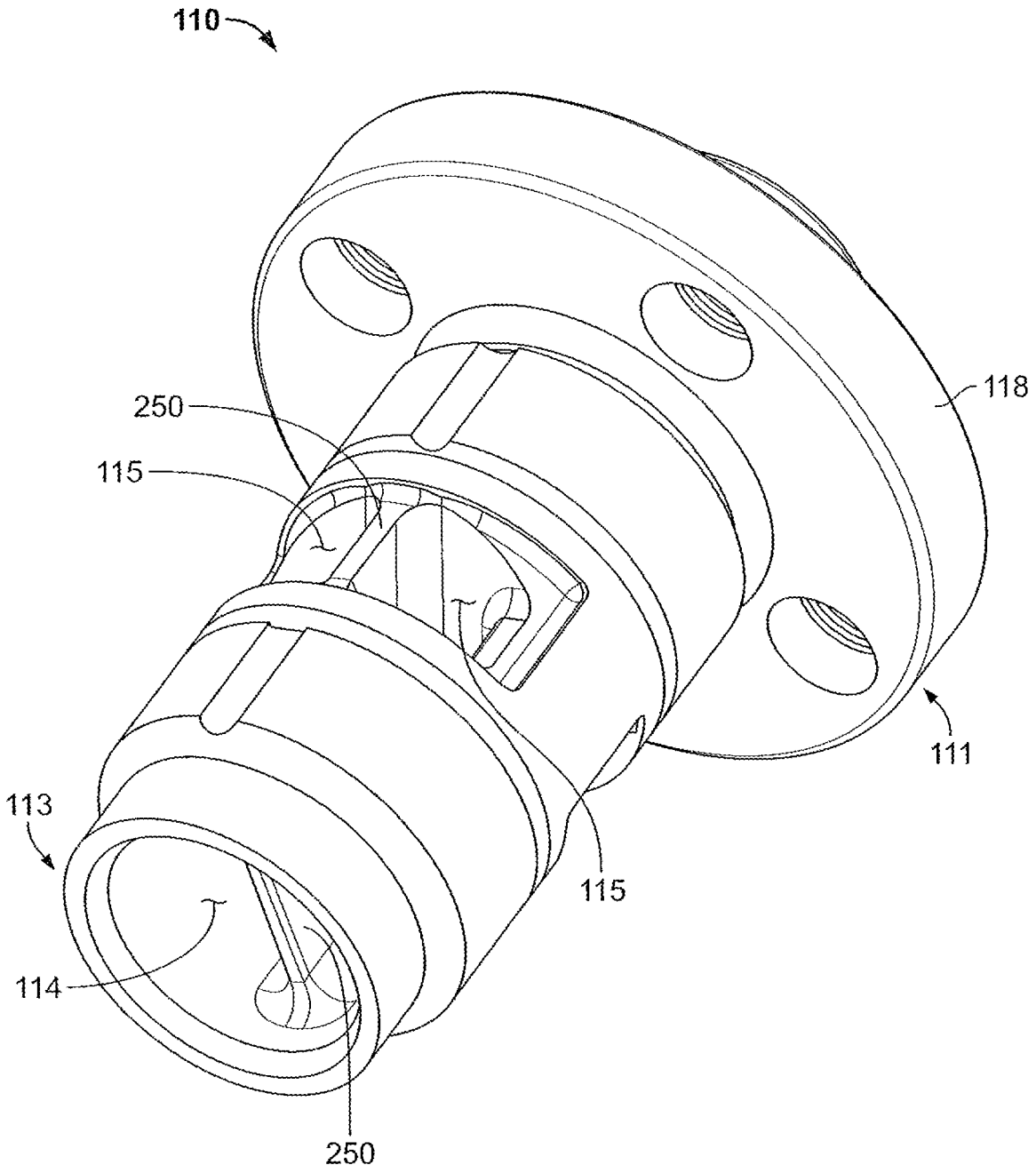
FIG. 17 is a top perspective view of an exemplary pintle.
Figure 18:
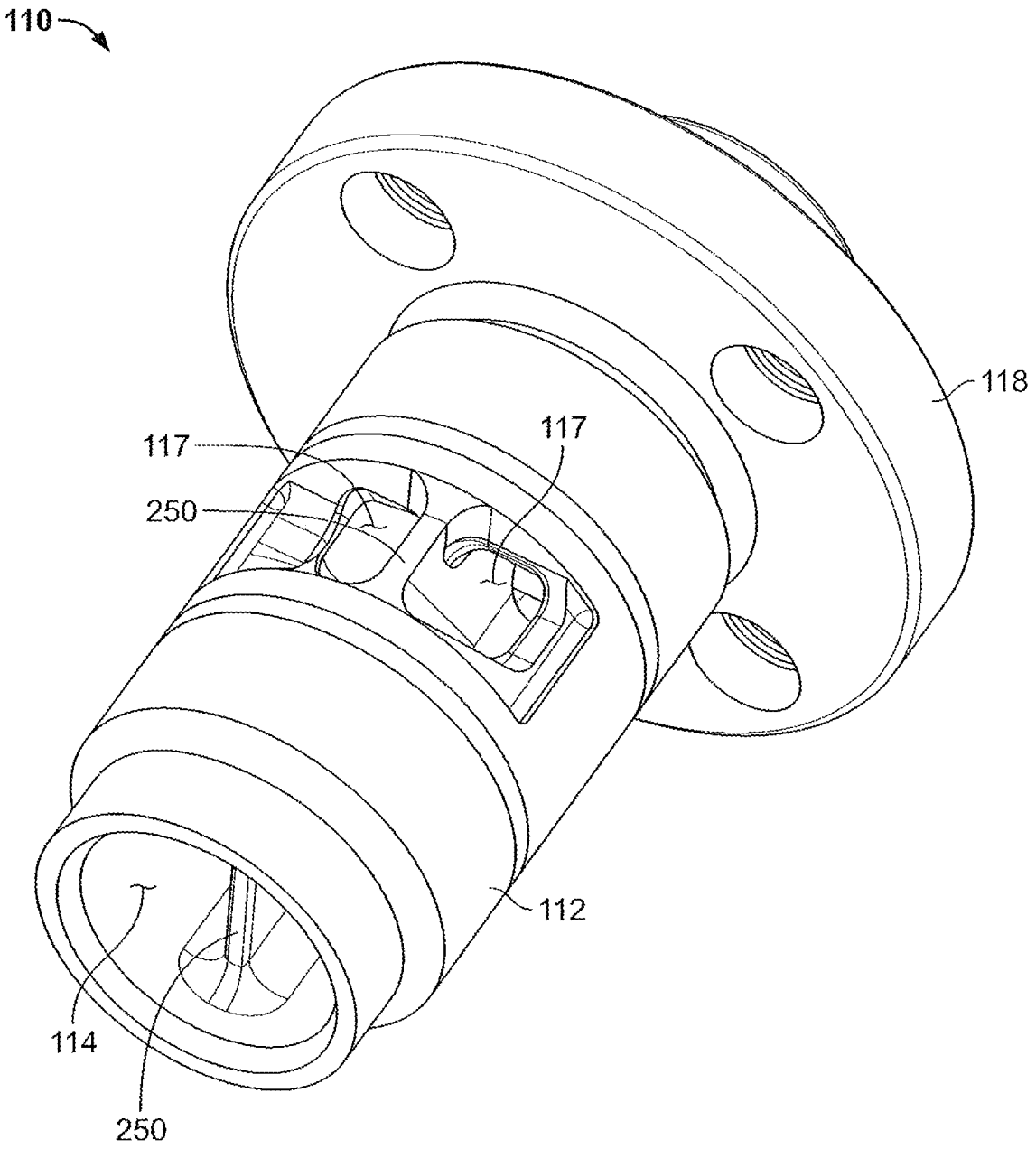
FIG. 18 is a bottom perspective view of the pintle of FIG. 17.

FIGS. 17-20, as well as FIG. 13, illustrate a pintle 110 according to another example of the present disclosure. In particular, FIG. 17 is a top perspective view of an exemplary pintle 110. FIG. 18 is a bottom perspective view of the pintle 110 of FIG. 17.

Figure 19:
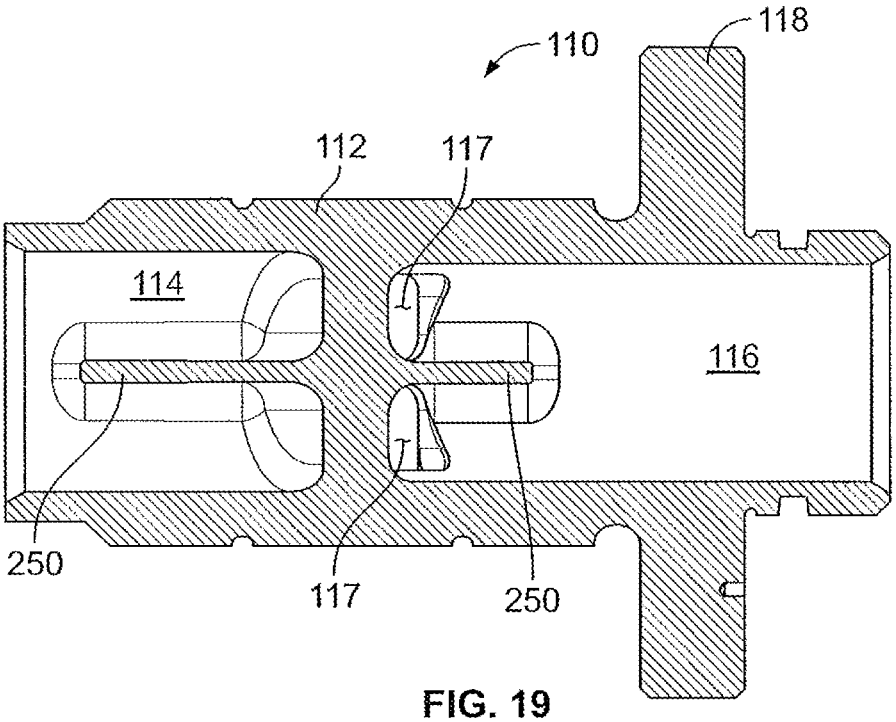
FIG. 19 is a cross-sectional view of the pintle of FIG. 17.
Figure 20:
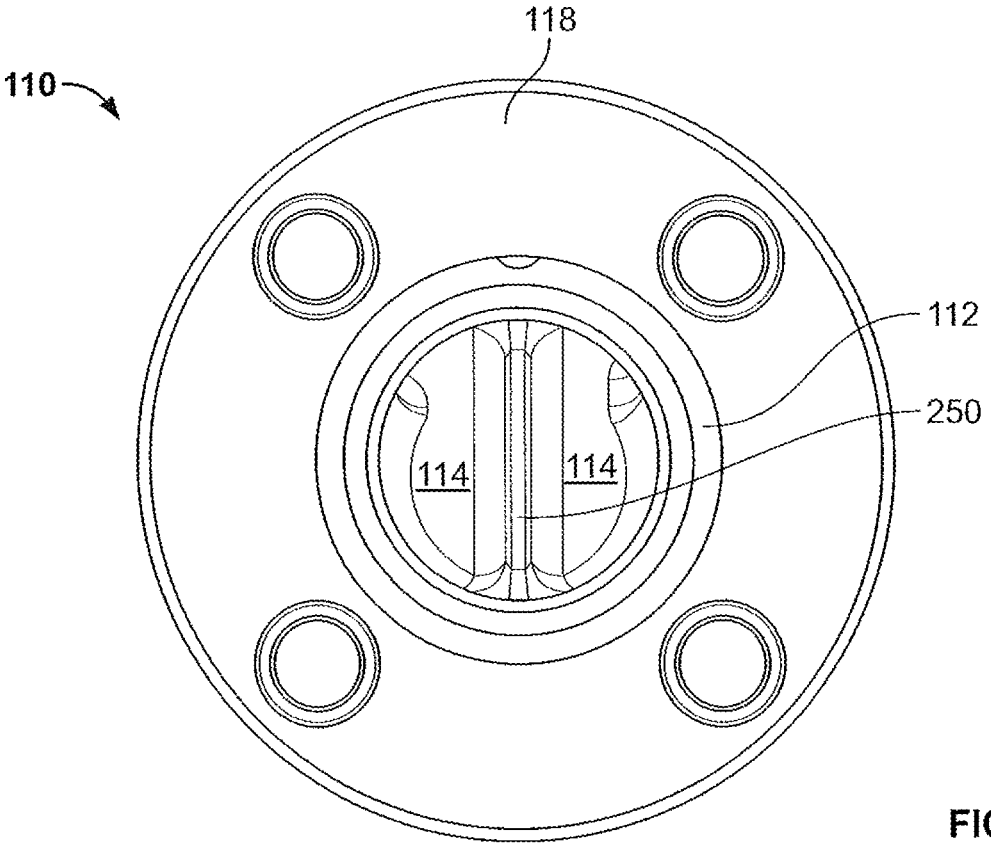
FIG. 20 is a front view of the pintle of FIG. 17.

FIG. 19 is a cross-sectional view of the pintle 110 of FIG. 17. FIG. 20 is a front view of the pintle 110 of FIG. 17. The concepts and features of the pintle 110 shown in FIGS. 13, and 17-20 are similar to the pintle 110 shown in FIGS. 1-3. Thus, the same reference numbers are used for the same or similar features or elements, and the description for the same or similar features of elements is omitted for brevity purposes. The following description will be limited primarily for the differences between the pintle 110 shown in FIGS. 13, and 17-20 and the pintle 110 shown in FIGS. 1-3.

In some examples, the pintle 110 further includes a pintle wall 250 formed within the pintle inlet 114 and/or the pintle outlet 116. In the depicted example, the pintle wall 250 divides the pintle inlet 114 and the pintle outlet 116 into a plurality of sections.

In some examples, the pintle wall 250 can divide the pintle inlet 114 and/or the pintle outlet 116 into two symmetrical sections about the wall 250. In some examples, the pintle wall 250 extends substantially along the entire of the pintle inlet port 115 and/or the pintle outlet port 117. In other examples, the pintle wall 250 is formed in a portion of the pintle inlet 114 adjacent the pintle second end 113. Similarly, the pintle wall 250 can be formed only in a portion of the pintle outlet 116 adjacent the pintle first end 111 (close to the mounting flange 118). In still other examples, the pintle wall 250 is formed only near the pintle inlet port 115 and/or the pintle outlet port 117.

In some examples, the pintle wall 250 extends to the pintle inlet port 115 and/or the pintle outlet port 117 so as to divide the pintle inlet port 115 and/or the pintle outlet port 117 into a plurality of sections. In some examples, the pintle wall 250 can divide the pintle inlet port 115 and/or the pintle outlet port 117 into two symmetrical sections about the wall 250.

The pintle wall 250 operates to stiffen the pintle 110 and improve strength of the pintle 110 under radial load exerted by hydraulic fluid flowing through the pintle shaft 110. Thus, the pintle wall 250 reduces deflection of the pintle shaft 110 relative to the mounting flange 118 fixed to the housing 102. Further, the pintle wall 250 reduces vortices of hydraulic fluid entering the pintle inlet 114, thereby decreasing a pressure loss of the hydraulic fluid at the pintle inlet 114.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A radial piston device comprising:

a housing having a hydraulic fluid inlet and a hydraulic fluid outlet;

a pintle having a first end and a second end opposite to the first end along a pintle axis, the pintle attached to the housing at the first end and having a pintle shaft between the first end and the second end, wherein the pintle shaft defines a pintle inlet and a pintle outlet, the pintle inlet in fluid communication with the hydraulic fluid inlet at the second end, and the pintle outlet in fluid communication with the hydraulic fluid outlet at the first end;

a rotor having a pintle bore mounted onto the pintle shaft, the rotor configured to rotate relative to the pintle about a rotor axis of rotation that extends through a length of the pintle shaft, the rotor defining a plurality of radially oriented cylinders and defining a plurality of rotor fluid ports;

a plurality of pistons, each being displaceable in each of the plurality of cylinders; and a drive shaft rotatably supported within the housing and having a driving end and a power transfer end, the drive shaft including a shaft body at the driving end, a power transfer flange at the power transfer end, and a stem connecting the shaft body and the power transfer flange between the driving end and the power transfer end, wherein the power transfer flange is coupled to the rotor and defines a drive shaft flow passage between the hydraulic fluid inlet and the pintle inlet of the pintle shaft;

wherein the stem includes a plurality of arms and an arm connection point, the plurality of arms extending from the power transfer flange and connected to the arm connection point, the plurality of arms having portions radially offset from a shaft axis of rotation, and the arm connection point connected to the shaft body, wherein the arm connection point is arranged to be axially offset from the drive shaft flow passage toward the shaft body;

wherein the arms are angled obliquely outwards as the arms extend from the shaft body to the power transfer flange.

2. The device according to claim 1, wherein the stem includes two arms extending from the power transfer flange to the arm connection point, the two arms being equally circumferentially spaced apart.

3. The device according to claim 1, wherein the plurality of arms has a leading edge and a trailing edge, the leading edge arranged ahead of the trailing edge in a rotational direction of the drive shaft, and the leading edge facing in the rotational direction of the drive shaft and being streamlined.

4. The device according to claim 3, wherein the leading edge has a tapered configuration.

5. The device according to claim 3, wherein the trailing edge has a tapered configuration.

6. The device according to claim 1, further comprising:

a funnel coupled to the pintle shaft at the second end thereof and configured to be open to the drive shaft flow passage to guide a hydraulic fluid from the hydraulic fluid inlet to the pintle inlet, the funnel arranged to remain stationary with respect to the pintle shaft as the rotor rotates about the pintle shaft.

7. The device according to claim 6, wherein the drive shaft flow passage includes a tapered inner surface configured to reduce passage losses as hydraulic fluid is drawn into the pintle inlet.

8. The device according to claim 6, wherein the rotor has a recess configured to receive at least a portion of the funnel for the funnel to be secured to the pintle shaft at the second end of the pintle.

9. The device according to claim 1, wherein the plurality of cylinders is in paired configuration to form cylinder sets including at least two cylinders, the at least two cylinders located adjacent one another along an axis parallel to a rotor axis, wherein the cylinder sets are offset from one another along an axis parallel to the rotor axis, wherein the rotor has a rotor inlet face and a rotor outlet face, wherein a first group of the cylinder sets are arranged closer to the rotor inlet face than to the rotor outlet face, and a second group of the cylinder sets are arranged closer to the outlet face than to the rotor inlet face, wherein the rotor includes common fluid chambers configured to provide a fluid communication between the cylinder sets and the rotor fluid ports, respectively, wherein a first group of the common fluid chambers are formed from the rotor inlet face along an axis parallel to the rotor axis, the first group of the common fluid chambers associated with the second group of the cylinder sets, and wherein a second group of the common fluid chambers are formed from the rotor outlet face along an axis parallel to the rotor axis, the second group of the common fluid chambers associated with the first group of the cylinder sets.

10. The device according to claim 9, wherein the rotor includes a recess formed around the pintle bore on the rotor inlet face, the recess configured to receive at least a portion of the funnel.

11. The device according to claim 1, wherein the housing includes an inlet chamber having a first chamber end and a second chamber end along a longitudinal axis of the housing, and wherein the inlet chamber has a side wall extending between the first chamber end and the second chamber end, the side wall configured to have a cross-sectional area of the inlet chamber at the first chamber end smaller than a cross-sectional area of the inlet chamber at the second chamber end.

12. The device according to claim 11, wherein the side wall is configured to be tapered from the first chamber end to the second chamber end such that a cross-sectional area of the inlet chamber gradually reduces from the first chamber end to the second chamber end.

13. The device according to claim 1, wherein the pintle includes a pintle wall extending at least partially within the pintle shaft along a pintle axis.

14. The device according to claim 13, wherein the pintle shaft defines a pintle inlet port and a pintle outlet port, and wherein the pintle wall is configured to divide at least partially the pintle inlet port and the pintle outlet port into a plurality of sections.

15. A radial piston device comprising:

a housing having a hydraulic fluid inlet and a hydraulic fluid outlet;

a pintle attached to the housing and having a pintle shaft, wherein the pintle shaft defines a pintle inlet and a pintle outlet, the pintle inlet in fluid communication with the hydraulic fluid inlet, and the pintle outlet in fluid communication with the hydraulic fluid outlet;

a rotor mounted on the pintle shaft and configured to rotate relative to the pintle about a rotor axis of rotation that extends through a length of the pintle shaft, the rotor defining a plurality of radially oriented cylinders;

a plurality of pistons, each being displaceable in each of the plurality of cylinders; and a drive shaft rotatably supported within the housing and having a driving end and a power transfer end, the drive shaft including a shaft body at the driving end, a power transfer flange at the power transfer end, and a stem connecting the shaft body and the power transfer flange between the driving end and the power transfer end, wherein the power transfer flange is coupled to the rotor and defines a drive shaft flow passage between the hydraulic fluid inlet and the pintle inlet of the pintle shaft, wherein the stem includes a plurality of arms and an arm connection point, the plurality of arms extending from the power transfer flange and connected to the arm connection point, the plurality of arms having portions radially offset from a shaft axis of rotation, and the arm connection point connected to the shaft body, wherein the arm connection point is arranged to be axially offset from the drive shaft flow passage toward the shaft body;

wherein the arms are angled obliquely outwards as the arms extend from the shaft body to the power transfer flange.

16. The device of claim 15, wherein the stem is arranged such that an inlet axis of the hydraulic fluid inlet is arranged between the arm connection point and the power transfer flange.

17. The device of claim 15, wherein the stem includes two arms extending from the power transfer flange to the arm connection point, the two arms being equally circumferentially spaced apart.

18. The device of claim 15, wherein the plurality of arms has a leading edge and a trailing edge, the leading edge arranged ahead of the trailing edge in a rotational direction of the drive shaft, and the leading edge facing in the rotational direction of the drive shaft and being streamlined, and the leading edge has an apex facing in the rotational direction of the drive shaft.

19. A radial piston device comprising:

a housing having a hydraulic fluid inlet and a hydraulic fluid outlet;

a pintle having a first end and a second end opposite to the first end along a pintle axis, the pintle attached to the housing at the first end and having a pintle shaft between the first end and the second end, wherein the pintle shaft defines a pintle inlet and a pintle outlet, the pintle inlet in fluid communication with the hydraulic fluid inlet at the second end, and the pintle outlet in fluid communication with the hydraulic fluid outlet at the first end;

a rotor having a pintle bore mounted onto the pintle shaft, the rotor configured to rotate relative to the pintle about a rotor axis of rotation that extends through a length of the pintle shaft, the rotor defining a plurality of radially oriented cylinders and defining a plurality of rotor fluid ports;

a plurality of pistons, each being displaceable in each of the plurality of cylinders; and a drive shaft rotatably supported within the housing and having a driving end and a power transfer end, the drive shaft including a shaft body at the driving end, a power transfer flange at the power transfer end, and a stem connecting the shaft body and the power transfer flange between the driving end and the power transfer end, wherein the power transfer flange is coupled to the rotor and defines a drive shaft flow passage between the hydraulic fluid inlet and the pintle inlet of the pintle shaft;

wherein the stem includes a plurality of arms and an arm connection point, the plurality of arms extending from the power transfer flange and connected to the arm connection point, the plurality of arms having portions radially offset from a shaft axis of rotation, and the arm connection point connected to the shaft body, wherein the arm connection point is arranged to be axially offset from the drive shaft flow passage toward the shaft body;

wherein the plurality of arms has a leading edge and a trailing edge, the leading edge arranged ahead of the trailing edge in a rotational direction of the drive shaft, and the leading edge facing in the rotational direction of the drive shaft and being streamlined.

20. The device according to claim 19, wherein the leading edge has a tapered configuration.

21. The device according to claim 19, wherein the trailing edge has a tapered configuration.

22. A radial piston device comprising:

a housing having a hydraulic fluid inlet and a hydraulic fluid outlet;

a pintle having a first end and a second end opposite to the first end along a pintle axis, the pintle attached to the housing at the first end and having a pintle shaft between the first end and the second end, wherein the pintle shaft defines a pintle inlet and a pintle outlet, the pintle inlet in fluid communication with the hydraulic fluid inlet at the second end, and the pintle outlet in fluid communication with the hydraulic fluid outlet at the first end;

a rotor having a pintle bore mounted onto the pintle shaft, the rotor configured to rotate relative to the pintle about a rotor axis of rotation that extends through a length of the pintle shaft, the rotor defining a plurality of radially oriented cylinders and defining a plurality of rotor fluid ports;

a plurality of pistons, each being displaceable in each of the plurality of cylinders;

a drive shaft rotatably supported within the housing and having a driving end and a power transfer end, the drive shaft including a shaft body at the driving end, a power transfer flange at the power transfer end, and a stem connecting the shaft body and the power transfer flange between the driving end and the power transfer end, wherein the power transfer flange is coupled to the rotor and defines a drive shaft flow passage between the hydraulic fluid inlet and the pintle inlet of the pintle shaft;

wherein the stem includes a plurality of arms and an arm connection point, the plurality of arms extending from the power transfer flange and connected to the arm connection point, the plurality of arms having portions radially offset from a shaft axis of rotation, and the arm connection point connected to the shaft body, wherein the arm connection point is arranged to be axially offset from the drive shaft flow passage toward the shaft body; and a funnel coupled to the pintle shaft at the second end thereof and configured to be open to the drive shaft flow passage to guide a hydraulic fluid from the hydraulic fluid inlet to the pintle inlet, the funnel arranged to remain stationary with respect to the pintle shaft as the rotor rotates about the pintle shaft.

23. The device according to claim 22, wherein the drive shaft flow passage includes a tapered inner surface configured to reduce passage losses as hydraulic fluid is drawn into the pintle inlet.

24. The device according to claim 22, wherein the rotor has a recess configured to receive at least a portion of the funnel for the funnel to be secured to the pintle shaft at the second end of the pintle.

25. A radial piston device comprising:

a housing having a hydraulic fluid inlet and a hydraulic fluid outlet;

a pintle having a first end and a second end opposite to the first end along a pintle axis, the pintle attached to the housing at the first end and having a pintle shaft between the first end and the second end, wherein the pintle shaft defines a pintle inlet and a pintle outlet, the pintle inlet in fluid communication with the hydraulic fluid inlet at the second end, and the pintle outlet in fluid communication with the hydraulic fluid outlet at the first end;

a rotor having a pintle bore mounted onto the pintle shaft, the rotor configured to rotate relative to the pintle about a rotor axis of rotation that extends through a length of the pintle shaft, the rotor defining a plurality of radially oriented cylinders and defining a plurality of rotor fluid ports;

a plurality of pistons, each being displaceable in each of the plurality of cylinders; and a drive shaft rotatably supported within the housing and having a driving end and a power transfer end, the drive shaft including a shaft body at the driving end, a power transfer flange at the power transfer end, and a stem connecting the shaft body and the power transfer flange between the driving end and the power transfer end, wherein the power transfer flange is coupled to the rotor and defines a drive shaft flow passage between the hydraulic fluid inlet and the pintle inlet of the pintle shaft;

wherein the stem includes a plurality of arms and an arm connection point, the plurality of arms extending from the power transfer flange and connected to the arm connection point, the plurality of arms having portions radially offset from a shaft axis of rotation, and the arm connection point connected to the shaft body, wherein the arm connection point is arranged to be axially offset from the drive shaft flow passage toward the shaft body;

wherein the plurality of cylinders is in paired configuration to form cylinder sets including at least two cylinders, the at least two cylinders located adjacent one another along an axis parallel to a rotor axis, wherein the cylinder sets are offset from one another along an axis parallel to the rotor axis, wherein the rotor has a rotor inlet face and a rotor outlet face, wherein a first group of the cylinder sets are arranged closer to the rotor inlet face than to the rotor outlet face, and a second group of the cylinder sets are arranged closer to the outlet face than to the rotor inlet face, wherein the rotor includes common fluid chambers configured to provide a fluid communication between the cylinder sets and the rotor fluid ports, respectively, wherein a first group of the common fluid chambers are formed from the rotor inlet face along an axis parallel to the rotor axis, the first group of the common fluid chambers associated with the second group of the cylinder sets, and wherein a second group of the common fluid chambers are formed from the rotor outlet face along an axis parallel to the rotor axis, the second group of the common fluid chambers associated with the first group of the cylinder sets.

26. The device according to claim 25, wherein the rotor includes a recess formed around the pintle bore on the rotor inlet face, the recess configured to receive at least portion of the funnel.

27. A radial piston device comprising:

a housing having a hydraulic fluid inlet and a hydraulic fluid outlet;

a pintle attached to the housing and having a pintle shaft, wherein the pintle shaft defines a pintle inlet and a pintle outlet, the pintle inlet in fluid communication with the hydraulic fluid inlet, and the pintle outlet in fluid communication with the hydraulic fluid outlet;

a rotor mounted on the pintle shaft and configured to rotate relative to the pintle about a rotor axis of rotation that extends through a length of the pintle shaft, the rotor defining a plurality of radially oriented cylinder;

a plurality of pistons, each being displaceable in each of the plurality of cylinders; and a drive shaft rotatably supported within the housing and having a driving end and a power transfer end, the drive shaft including a shaft body at the driving end, a power transfer flange at the power transfer end, and a stem connecting the shaft body and the power transfer flange between the driving end and the power transfer end, wherein the power transfer flange is coupled to the rotor and defines a drive shaft flow passage between the hydraulic fluid inlet and the pintle inlet of the pintle shaft, wherein the stem includes a plurality of arms and an arm connection point, the plurality of arms extending from the power transfer flange and connected to the arm connection point, the plurality of arms having portions radially offset from a shaft axis of rotation, and the arm connection point connected to the shaft body, wherein the arm connection point is arranged to be axially offset from the drive shaft flow passage toward the shaft body;

wherein the plurality of arms has a leading edge and a trailing edge, the leading edge arranged ahead of the trailing edge in a rotational direction of the drive shaft, and the leading edge facing in the rotational direction of the drive shaft and being streamlined, and the leading edge has an apex facing in the rotational direction of the drive shaft.

* * * * *